US007076179B2

(12) United States Patent
Nakazato

(10) Patent No.: US 7,076,179 B2
(45) Date of Patent: Jul. 11, 2006

(54) IMAGE FORMING APPARATUS AND A STORAGE CONTROLLING METHOD FOR INFORMATION ON AN IMPROPER DETACHMENT OF DEVELOPER CARTRIDGE TO BE WRITTEN IN A CARTRIDGE STORAGE MEANS

(75) Inventor: Hiroshi Nakazato, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 178 days.

(21) Appl. No.: 10/801,492

(22) Filed: Mar. 16, 2004

(65) Prior Publication Data

US 2004/0223772 A1 Nov. 11, 2004

(30) Foreign Application Priority Data

Mar. 20, 2003 (JP) ..... 2003-077251
Mar. 20, 2003 (JP) ..... 2003-077252
Mar. 20, 2003 (JP) ..... 2003-077253
Mar. 20, 2003 (JP) ..... 2003-077254

(51) Int. Cl.
*G03G 15/00* (2006.01)
*G03G 15/08* (2006.01)

(52) U.S. Cl. ..... 399/13; 399/27; 399/119; 399/227

(58) Field of Classification Search ..... 399/27, 399/24, 28, 53, 13, 227, 223, 120, 110, 112
See application file for complete search history.

(56) References Cited

U.S. PATENT DOCUMENTS 6,560,423 B1 5/2003 Matsubara ..... 399/107
6,892,039 B1 * 5/2005 Okamoto et al. ..... 399/119 X
2001/0051053 A1 12/2001 Matsubara ..... 399/27
2003/0133719 A1 * 7/2003 Tsuruya et al. ..... 399/13 X
2004/0126123 A1 * 7/2004 Koga et al. ..... 399/24
2005/0123310 A1 * 6/2005 Ishibashi et al. ..... 399/27

FOREIGN PATENT DOCUMENTS

JP 2001-290400 10/2001
JP 2002-023595 1/2002
JP 2002-341706 11/2002
JP 2003-255647 A * 9/2003
JP 2004-004899 A * 1/2004

OTHER PUBLICATIONS

* Japanese Publication No. 2001-290400 corresponds to U.S. Patent No. 6,560,423 and publication No. US2001/0051053 A1.

* cited by examiner

*Primary Examiner*—Sophia S. Chen
(74) *Attorney, Agent, or Firm*—Hogan & Hartson LLP

(57) ABSTRACT

When an apparatus is turned on, one developer is positioned to a reading/writing position and a specific area of a cartridge memory is read to judge whether or not an improper detachment flag is set. Unless the improper detachment flag is set, the improper detachment flag is set in the specific area of the cartridge memory after information on life saved in the cartridge memory is read and written in a main-body memory.

22 Claims, 18 Drawing Sheets

HOME POSITION

DEVELOPING POSITION
(READING/WRITING POSITION)

DETACHMENT POSITION

IMAGE FORMING APPARATUS AND A STORAGE CONTROLLING METHOD FOR INFORMATION ON AN IMPROPER DETACHMENT OF DEVELOPER CARTRIDGE TO BE WRITTEN IN A CARTRIDGE STORAGE MEANS

BACKGROUND OF THE INVENTION

1. Field of the Invention

The invention relates to an image forming apparatus in which a cartridge storage means for saving intrinsic information including information on the life of a developer cartridge is provided in the developer cartridge constructed to be detachably mountable into an apparatus main body, and a storage controlling method for information on an improper detachment of the developer cartridge to be written in the cartridge storage means.

2. Description of the Related Art

In printers, copiers, facsimile apparatuses and like image forming apparatuses for forming images using toner, a toner container is so constructed into a developer cartridge as to be detachably mountable into an apparatus main body, so that user can easily replenish the toner himself (for example, see Japanese Unexamined Patent Publication No. 2002-23595). In an apparatus disclosed in Japanese Unexamined Patent Publication No. 2002-23595, a developer is moved to a specified detachment position when user turns a switch on during a non-recording operation.

Further, some of such constructions in which the developer cartridge is detachably mountable have been known to provide a cartridge memory formed of, e.g. a nonvolatile memory for saving intrinsic information of the developer cartridge such as information on the life of the developer cartridge including an amount of toner contained in the developer cartridge, the color of the toner, and the production date of the developer cartridge (for example, see Japanese Unexamined Patent Publications Nos. 2002-341706, 2001-290400). An apparatus disclosed in Japanese Unexamined Patent Publication No. 2002-341706 is constructed such that a main-body controller reads and writes information from and in the cartridge memory with a developer-cartridge side connector electrically connected with the cartridge memory and a main-body side connector electrically connected with the main-body controller connected with each other. An apparatus disclosed in Japanese Unexamined Patent Publication No. 2001-290400 is constructed such that information is read and written from and in the cartridge memory in a noncontacting manner via an antenna.

In the above-mentioned conventional apparatuses, the reading and writing from and in the cartridge memory are discontinuously performed at specified timings such as the detachment timing of the developer cartridge, for example, in view of how often rewriting can be made in a nonvolatile memory until the life of the nonvolatile memory ends, how often the connectors can be connected to connect the apparatus main body and the developer cartridge until the lives of the connectors end, and how often an actuator for moving the connectors toward and away from each other can be driven until the life thereof ends. Accordingly, information on the life saved in the cartridge memory does not always agree with the latest data.

For example, if the reading and writing from and in the cartridge memory are performed only when the developer cartridge is detached, the information on the life saved in the cartridge memory of the mounted developer cartridge does not agree with the latest data until the developer cartridge is detached from the apparatus main body.

Since the developer cartridge is so constructed as to be exchangeable by the user himself as described above, it may be used as follows, for example, upon mass printing. Specifically, the developer cartridge being used is temporarily detached and stored, and, after a new developer cartridge is mounted and mass printing is carried out, the new developer cartridge is detached and the old one is mounted again. In the case of using the developer cartridge mentioned above, unless the latest data on the life is written in the cartridge memory so that the information on the life agrees with the latest data before the developer cartridge is detached, the information on the life read from the cartridge memory when the developer cartridge is mounted again is incorrect. Therefore, the life of the developer cartridge cannot be precisely administered.

However, depending on the construction of the image forming apparatus, the developer cartridge can be improperly detached by a user before the information in the cartridge memory is updated.

For example, in such a construction in which a reading/writing position from/in the cartridge memory differs from the detachment position for the developer cartridge and the developer cartridge passes its detachment position while being moved to the reading/writing position from/in the cartridge memory, the user may inadvertently detach the developer cartridge when the developer cartridge passes the detachment position.

Further, if the developer cartridge accidentally stops at the detachment position when power supply is inadvertently shut off during the operation, for example, due to a power failure or the maloperation of a power switch by the user, the developer cartridge may be detached by the user.

Upon such an improper detachment, the information on the life in the cartridge memory is not updated to the latest data. Thus, the life cannot be precisely administered even if the saved content of the cartridge memory is read when the detached developer cartridge is used again later.

SUMMARY OF THE INVENTION

In view of the problems mentioned above, a first object of the invention is to enable a discrimination as to an improper detachment of a developer cartridge from an apparatus main body in an image forming apparatus in which a cartridge memory is provided in a detachably mountable developer cartridge.

A second object of the invention is to enable a discrimination as to whether an exchange of a developer cartridge has been properly completed without improperly detaching the developer cartridge in an image forming apparatus in which a cartridge memory is provided in a detachably mountable developer cartridge.

A third object of the invention is to enable a discrimination on an improper detachment of a developer cartridge while a power source is inadvertently shut off in an image forming apparatus in which a cartridge memory is provided in a detachably mountable developer cartridge.

According to a first aspect of the present invention, there is provided an image forming apparatus, comprising: a developer cartridge containing a toner and detachably mountable into an apparatus main body; a cartridge storage means for saving intrinsic information including information on the life of the developer cartridge provided in the developer cartridge; and a first main-body controlling means for writing improper detachment information for making an improper detachment of the developer cartridge from the apparatus main body recognizable in the cartridge storage means.

According to a second aspect of the present invention, there is provided an image forming apparatus, comprising: a developer cartridge containing a toner and detachably mountable into an apparatus main body; a cartridge storage means for saving intrinsic information including information on the life of the developer cartridge provided in the developer cartridge; and a second main-body controlling means, wherein a cartridge exchange mode in which the developer cartridge is exchanged is provided as an operation mode in addition to an image forming mode in which the image formation is carried out, and the second main-body controlling means is provided to write exchange completion information indicating that the exchange has been normally completed in the cartridge storage means at a specified timing in the cartridge exchange mode.

According to a third aspect of the present invention, there is provided an image forming apparatus, comprising: a developer cartridge containing a toner and detachably mountable into an apparatus main body; a cartridge storage means for saving intrinsic information including information on the life of the developer cartridge provided in the developer cartridge; and a third main-body controlling means for reading information written in the cartridge storage means of the developer cartridge being mounted when a power supply is restored from an improper shutoff thereof.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

BRIEF DESCRIPTION OF THE DRAWINGS

FIG. 16 is a flow chart showing a procedure when the apparatus is turned on;

DETAILED DESCRIPTION OF THE PREFERRED EMBODIMENTS

First Preferred Embodiment

Figure 1:
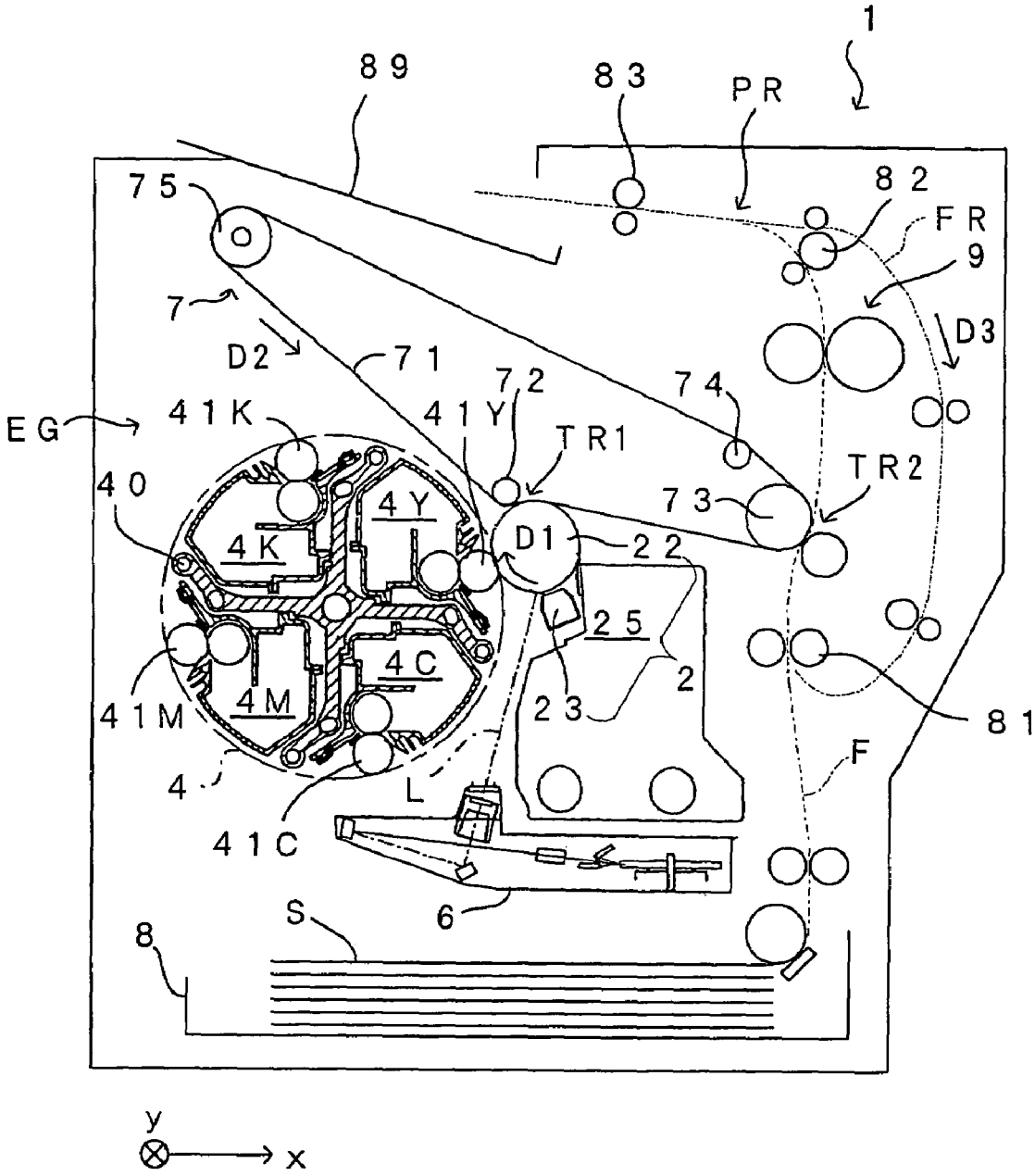
FIG. 1 is a diagram showing a first preferred embodiment of an image forming apparatus according to the invention.

FIG. 1 is a diagram showing a first preferred embodiment of an image forming apparatus according to the invention. This apparatus is an image forming apparatus for forming a full color image by superimposing images of toners of four colors: yellow (Y), cyan (C), magenta (M) and black (K) and forming a monochromatic image only using the black (K) toner. In this image forming apparatus, when a print command signal including an image signal is given from an external apparatus such as a host computer to a controller (CPU) 160 (see FIG. 5), an engine section EG provided in an apparatus main body 1 executes a specified image forming operation in accordance with a command from the CPU 160, whereby an image corresponding to the image signal is formed on a sheet S.

In this engine section EG, a photosensitive member 22 is rotatably provided in a direction of arrow D1 of FIG. 1. Further, a charger unit 23, a rotary developing unit 4 and a cleaning section 25 are arranged around the photosensitive member 22 along its rotating direction D1. A specified charging bias is applied to the charger unit 23 to uniformly charge the outer circumferential surface of the photosensitive member 22 at a specified surface potential. The photosensitive member 22, the charger unit 23 and the cleaning section 25 are incorporated into a photosensitive-member cartridge 2, which is detachably mountable into the apparatus main body 1 as a single unit.

A light beam L is emitted from an exposure unit 6 toward the outer circumferential surface of the photosensitive member 22 charged by the charger unit 23. This exposure unit 6 exposes the photosensitive member 22 by the light beam L in accordance with the image signal given from the external apparatus to form an electrostatic latent image corresponding to the image signal.

The thus formed electrostatic latent image is developed into a toner image by the rotary developing unit 4. Specifically, the developing unit 4 includes a supporting frame 40 rotatably provided about a rotary shaft 4*a* (see FIG. 3), and a developer for yellow 4Y, a developer for cyan 4C, a developer for magenta 4M and a developer for black 4K containing the toners of the respective colors and constructed as cartridges detachably mountable into the supporting frame 40. This developing unit 4 is controlled by the CPU 160. The developing unit 4 is rotated in accordance with a control command from the CPU 160. When the developers 4Y, 4C, 4M, 4K thereof are selectively brought into contact with the photosensitive member 22 or positioned at a specified developing position facing the photosensitive member 22 at a specified gap, the toner is imparted from a developing roller (developing roller 41Y in FIG. 1) provided in this developer (developer 4Y in FIG. 1) and carrying the toner of the selected color to the outer surface of the photosensitive member 22. In this way, the electrostatic latent image on the photosensitive member 22 is developed in the selected toner color. In this embodiment, the supporting frame 40 corresponds to a "cartridge supporting means" of the invention and the developers 4Y, 4C, 4M and 4K correspond to "developer cartridges" of the invention.

The toner image developed by the developing unit 4 as described above undergoes a primary transfer onto an intermediate transfer belt 71 of a transfer unit 7 in a primary transfer region TR1. The transfer unit 7 includes the intermediate transfer belt 71 mounted on a plurality of rollers 72 to 75 and a driving device (not shown) for driving the roller 73 to turn the intermediate transfer belt 71 in a specified turning direction D2. In the case of transferring a color image onto the sheet S, the toner images of the respective colors formed on the photosensitive member 22 are superimposed on the intermediate transfer belt 71 to form the color image, which then undergoes a second transfer onto the sheet S dispensed one by one from a cassette 8 and conveyed to a secondary transfer region TR2 along a conveyance path F.

At this time, a timing at which the sheet S is fed to the secondary transfer region TR2 is controlled in order to properly transfer the image on the intermediate transfer belt 71 to a specified position on the sheet S. Specifically, gate rollers 81 are provided before the second transfer region TR2 in the conveyance path F, and the sheet S is fed to the secondary transfer region TR2 at a specified timing by rotating the gate rollers 81 in conformity with a turning timing of the intermediate transfer belt 71.

The sheet S having the color image thus formed thereon is conveyed to be discharged onto a discharge tray 89 provided on the upper surface of the apparatus main body 1 via a fixing unit 9, pre-discharge rollers 82 and discharge rollers 83. Further, in the case of forming images on both surfaces of the sheet S, the rotating directions of the discharging rollers 83 are reversed when the trailing end of the sheet S having the image formed on one surface thereof as described above reaches a reversing position PR behind the pre-discharge rollers 82, whereby the sheet S is conveyed in a direction of arrow D3 along a reversing conveyance path FR. Then, the sheet S enters the conveyance path F again before the gate rollers 81. At this time, the surface of the sheet S to be brought into contact with the intermediate transfer belt 71 in the secondary transfer region TR2 to have an image transferred thereto is the surface opposite from the one where the image was already transferred. In this way, the images can be formed on both surfaces of the sheet S.

Figure 2:
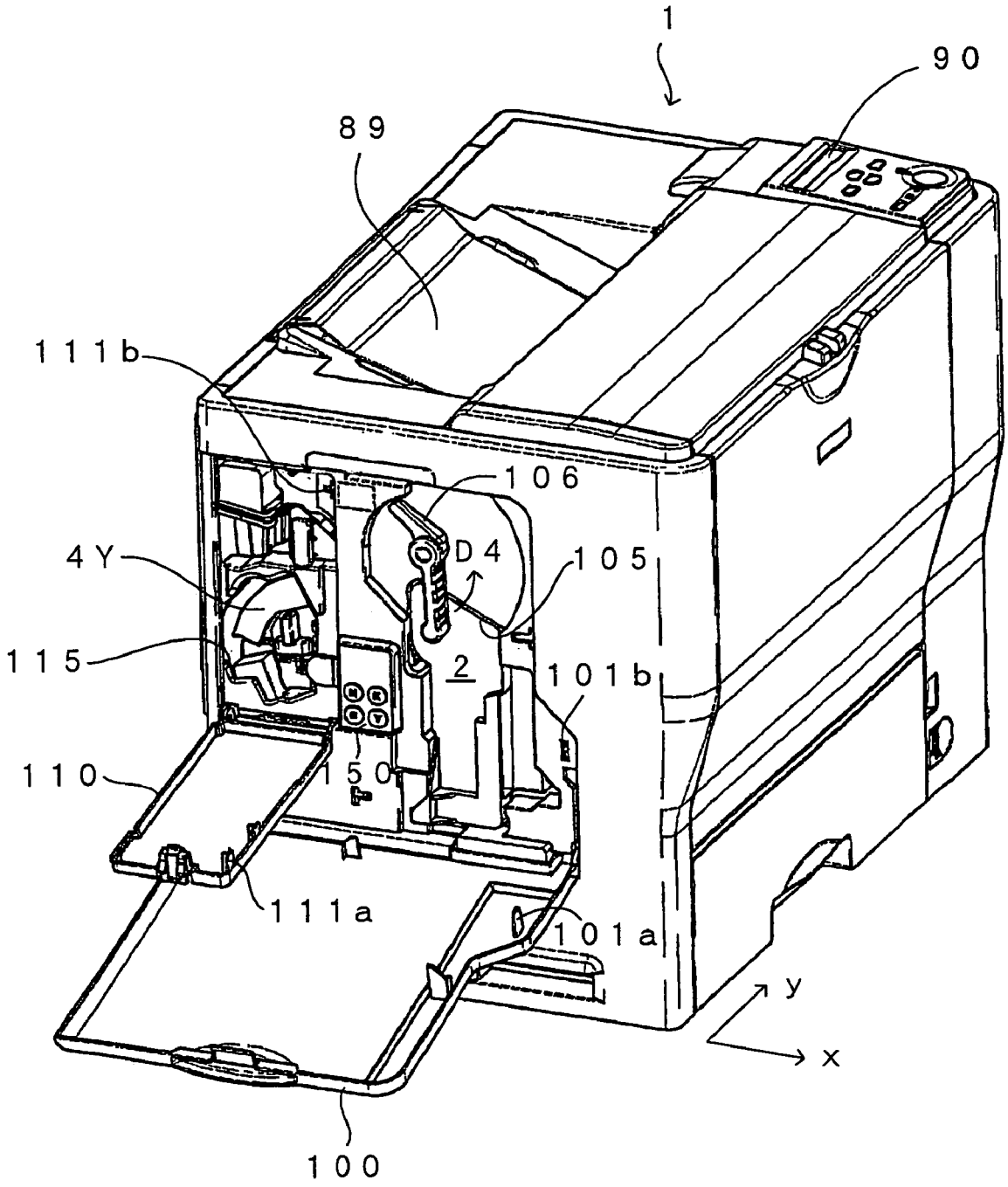
FIG. 2 is a perspective view showing the external configuration of the image forming apparatus of FIG. 1.

FIG. 2 is a perspective view showing the outer configuration of the image forming apparatus of FIG. 1. As mentioned above, the respective developers 4Y, 4C, 4M, 4K are detachably mountable into the supporting frame 40 of the apparatus main body 1 and the photosensitive member cartridge 2 is detachably mountable into the apparatus main body 1 in this image forming apparatus. As shown in FIG. 2, an outer cover 100 free to open and close is provided at one side surface of the apparatus main body 1. When the user opens the outer cover 100, a side portion of the photosensitive member cartridge 2 is exposed through a photosensitive member opening 105 formed in the apparatus main body 1. The photosensitive member cartridge 2 is freed from a locked state by turning a locking lever 106 for fixing the photosensitive member cartridge 2 in a direction of arrow D4, whereby the photosensitive member cartridge 2 can be withdrawn along (−y)-axis direction of FIG. 2. Further, by inserting the photosensitive member cartridge 2 through the photosensitive member opening 105 along y-axis direction of FIG. 2, a new photosensitive member cartridge 2 can be mounted. Then, the photosensitive member cartridge 2 is fixed by the locking lever 106. When the photosensitive member cartridge 2 is mounted in this way, the photosensitive member opening 105 is substantially closed by the side portion of the photosensitive member cartridge 2.

The apparatus main body 1 is also formed with a developer opening 115 through which the developers 4Y, 4C, 4M, 4K are mounted and detached. An inner cover 110 free to open and close is so provided as to close this developer opening 115. This inner cover 110 is provided at the inner side of the outer cover 100. In other words, the inner cover 110 cannot be opened with the outer cover 100 left closed since the outer cover 100 is formed to cover the developer opening 115 as well. Conversely, the outer cover 100 cannot be closed unless the inner cover 110 is closed. If the developing unit 4 is standing at a specified detachment position when the user opens this inner cover 110, one of the mounted developers can be detached through the developer opening 115. Further, one developer can be mounted through the developer opening 115.

As described above, in this embodiment, the developer opening 115 corresponds to a "developer cartridge opening" of the invention, and the inner cover 110 corresponds to a "cover for closing the developer cartridge opening" of the invention.

The outer cover 100 is provided with a projection 101*a*, whereas a hole 101*b* is formed at a position of the apparatus main body 1 corresponding to this projection 101*a*. Further, a limit switch 102 to be described later is mounted at the bottom of the hole 101*b*. When the outer cover 100 is closed, the projection 101*a* is introduced into the hole 101*b* formed in the apparatus main body 1 to push the limit switch 102 provided at the bottom of the hole 101*b*, thereby closing a contact of the limit switch 102.

The inner cover 110 is also provided with a mechanism similar to the above. Specifically, a projection 111*a* is provided on the inner cover 110, whereas a hole 111*b* is formed at a corresponding position of the apparatus main body 1. When the inner cover 110 is closed, the projection 111*a* is introduced into the hole 111*b* to push a limit switch 112 (to be described later) provided at the bottom of the hole 111*b*, thereby closing a contact of the limit switch 112.

Further, a limit switch (not shown) is provided at the back side of the photosensitive member opening 105, and a contact thereof is closed when the photosensitive member cartridge 2 is mounted into the apparatus main body 1. This limit switch is desirably so installed as to close its contact with the photosensitive member cartridge 2 properly mounted in the apparatus main body 1 while not closing its contact in an incompletely mounted state of the photosensitive member cartridge 2. This is because it is necessary to securely detect that the photosensitive member cartridge 2 is mounted so that the developing unit 4 is not rotated in the incompletely mounted state of the photosensitive member cartridge 2 to damage the apparatus.

As described above, in this image forming apparatus, whether the outer cover 100 and the inner cover 110 are open or closed and whether or not the photosensitive member cartridge 2 is mounted in the apparatus main body 1 can be detected from the contact states of the respective limit switches. An image formation mode in which the aforementioned image forming operation is performed can be entered only with the outer cover 100 and the inner cover 110 closed and with the photosensitive member cartridge 2 mounted. It should be noted that a display panel 90 for displaying messages to the user is provided at a suitable position of the upper surface of the apparatus main body 1.

Figure 3A:
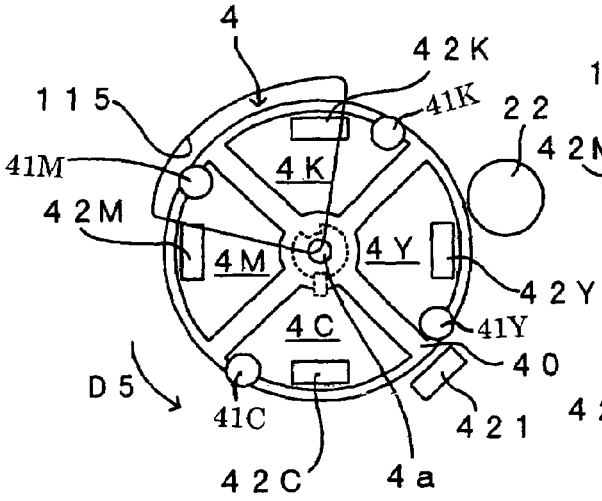
FIGS. 3A, 3B and 3C are diagrams showing stop positions of a developer unit.
Figure 3B:
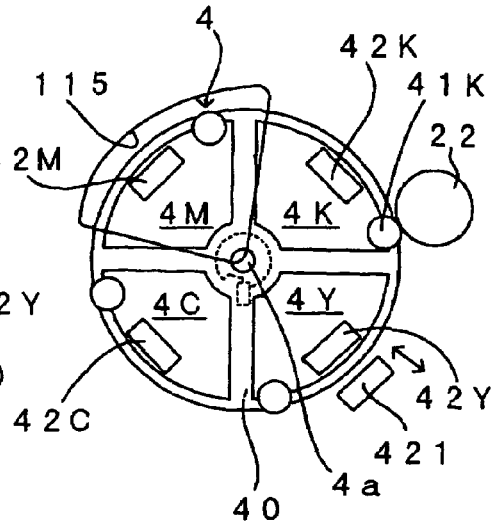
Figure 3C:
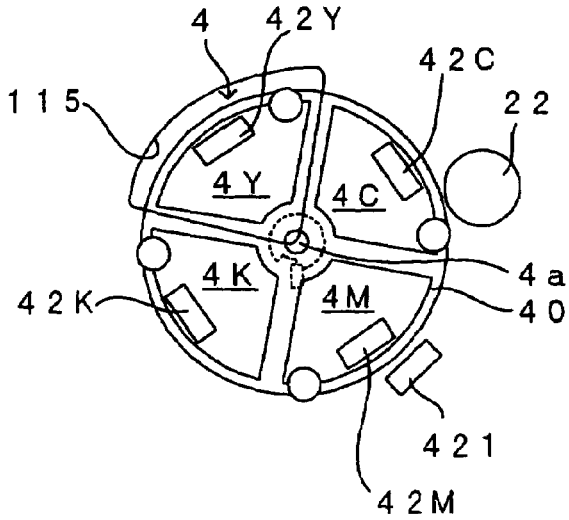

FIGS. 3A, 3B and 3C are diagrams showing stop positions of the developing unit 4. The developing unit 4 is rotated in a direction of arrow D5 in accordance with a control command from the CPU 160, and can be positioned and fixed at three kinds of positions shown in FIGS. 3A, 3B and 3C by the CPU 160 and an unillustrated rotary locking mechanism. These three positions are: (a) home position (FIG. 3A); (b) developing position (reading/writing position) (FIG. 3B); and (c) detachment position (FIG., 3C). The home position (a) is a position to which the developing unit 4 is positioned when the image forming apparatus is in a standby state where no image forming operation is performed. As shown in FIG. 3A, at this home position, all the developing rollers 41Y, 41C, 41M, 41K provided in the respective developers 4Y, 4C, 4M, 4K are distanced from the photosensitive member 22 and none of the developers 4Y, 4C, 4M, 4K can be detached through the developer opening 115 formed in the apparatus main body 1.

The developing position (b) is a position to which the developing unit 4 is positioned when an electrostatic latent image on the photosensitive member 22 is developed in a selected toner color. As shown in FIG. 3B, the developing roller (developing roller 41K provided in the developer 4K for black in the shown example) provided in one developer is so located as to face the photosensitive member 22, and the electrostatic latent image is developed by toner by applying a specified developing bias. At this developing position as well, none of the developers can be detached through the developer opening 115. If the outer cover 100 is opened during the image forming operation, the image forming operation is immediately stopped and the developing unit 4 stops after being moved to the home position. It should be noted that the developing position (b) also serves as a reading/writing position, which is to be described later.

The detachment position (c) is a position taken only upon mounting and detaching the developer. When the developing unit 4 is positioned to this detachment position, one developer appears in the developer opening 115 and can be detached through the developer opening 115 as shown in FIG. 3C. FIG. 3C shows a state where the developer 4Y for yellow appears in the developer opening 115. Further, a new developer can be mounted into the supporting frame 40 carrying no developer. At this detachment position, the developing rollers of all the developers are distanced from the photosensitive member 22. In this way, only one developer appearing in the developer opening 115 can be detached when the developing unit 4 is positioned at the detachment position. Thus, there is no possibility that the user inadvertently mounts or detaches the developer to damage the apparatus.

Since the developing position and the detachment position mentioned above are set for each of the four developers 4Y, 4C, 4M, 4K in this image forming apparatus, there are nine stop positions of the developing unit 4 including one home position.

Here, why the developing position (b) also serves as the reading/writing position is described. In FIG. 3B, a developer side connector 42Y, 42C, 42M, 42K is secured to one end surface of the corresponding developer 4Y, 4C, 4M, 4K, and is electrically connected with a corresponding cartridge memory 43Y, 43C, 43M, 43K (see FIG. 5). Each of the cartridge memories 43Y, 43C, 43M, 43K is adapted to save intrinsic information of the corresponding developer 4Y, 4C, 4M, 4K such as information on the life of the developer 4Y, 4C, 4M, 4K, the production lot, production date and the characteristics of the contained toner including color. For example, an amount of the contained toner is saved as the information on the life in this embodiment. The amount of the contained toner is read by the CPU 160 as described later and written in a main-body memory 161 (see FIG. 5) to be used for the calculation of a remaining amount of the toner. As described later, the calculated remaining amounts of the toners are renewably saved in the cartridge memories 43Y, 43C, 43M, 43K as the amounts of the contained toners.

When the developing unit 4 is positioned to the developing position as shown in FIG. 3B, the connector of the developer located one before the developer facing the photosensitive member 22 with respect to the direction of arrow D5 (for example, when the developer 4K is positioned to face the photosensitive member 22 as shown in FIG. 3B, the connector 42Y secured to the developer 4Y located one before the developer 4K with respect to the direction of arrow D5) is positioned to face a main-body side connector 421 provided in the apparatus main body 1.

This main-body side connector 421 is movable toward and away (directions of arrows in FIG. 3B) from the developing unit 4. The connector 421 is moved toward the developing unit 4 by a drawer motor 45 (see FIG. 5) driven by a motor driving circuit 44 (see FIG. 5) to be connected with the developer side connector located at the position facing the connector 421. Thereupon, the cartridge memory 43Y, 43C, 43M, 43K can be electrically connected with the CPU 160 of the apparatus main body 1 via the two connectors, and information is read and written from and in the cartridge memory 43Y, 43C, 43M, 43K by the CPU 160. In this way, detection as to whether the respective developers 4Y, 4C, 4M, 4K are mounted, the administration of the life, etc. are carried out. After the reading and writing by the CPU 160 are completed, the main-body side connector 421 is moved away from the developer side connector and returned to a retracted position. It should be noted that each of the developer side connectors 42Y, 42C, 42M, 42K is provided with loop-back wiring, and whether or not the two connectors are connected can be discriminated based on signal levels of a pair of terminals of the main-body side connector 421 connected with this wiring.

In this embodiment, when the developing unit 4 is positioned to the developing position, the developer side connector 42Y, 42C, 42M, 42K is mechanically connected with the main-body side connector 421 of the apparatus main body 1 to carry out the reading and writing from and in the cartridge memory 43Y, 43C, 43M, 43K. However, the reading and writing may be carried out in a noncontacting manner using an electromagnetic means such as a radio communication using, for example, infrared rays. The cartridge memories 43Y, 43C, 43M, 43K are desirably nonvolatile memories capable of storing data even if the power supply is off and/or the developers 4Y, 4C, 4M, 4K are detached from the apparatus main body 1. For example, EEPROMs such as flash memories and ferroelectric RAMs may be used as such nonvolatile memories. In this embodiment, the cartridge memories 43Y, 43C, 43M, 43K correspond to a "cartridge storage means" of the invention.

Figure 4:
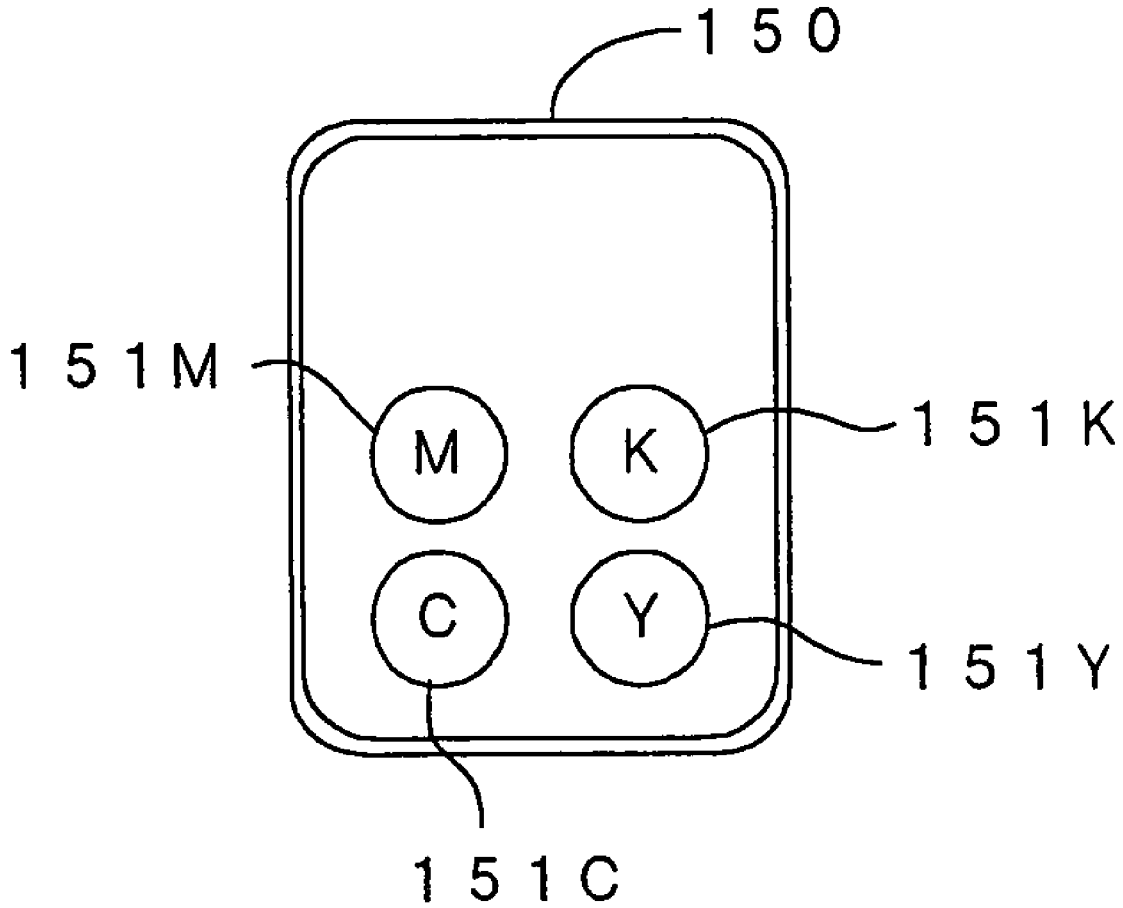
FIG. 4 is a diagram showing a developer operating section of the image forming apparatus of FIG. 1.

FIG. 4 is a diagram showing a developer operating section of the image forming apparatus. This developer operating section 150 is provided at the right side of the inner cover 110 as shown in FIG. 2. As described above, in this image forming apparatus, the developing unit 4 is positioned at the home position in the standby state where no image forming operations is performed. The developing unit 4 also stops after moving to the home position when the outer cover 100 is opened during the image forming operation. Thus, the developer cannot be immediately detached even if the user opens the outer cover 100 and subsequently opens the inner cover 110 to expose the developer opening 115.

In this image forming apparatus, the developer cannot be detached until the user operates the developer operating section 150 shown in FIG. 4 to move the rotary developing unit 4 to the detachment position. Specifically, when the user presses one of developer operating buttons 151M, 151K, 151C, 151Y provided in the developer operating section 150 corresponding to the toner color he desires to be exchanged, the developing unit 4 is rotated by a specified amount to be positioned to the detachment position in a procedure to be described later. As a result, the developer corresponding to the selected toner color appears in the developer opening 115.

Figure 5:
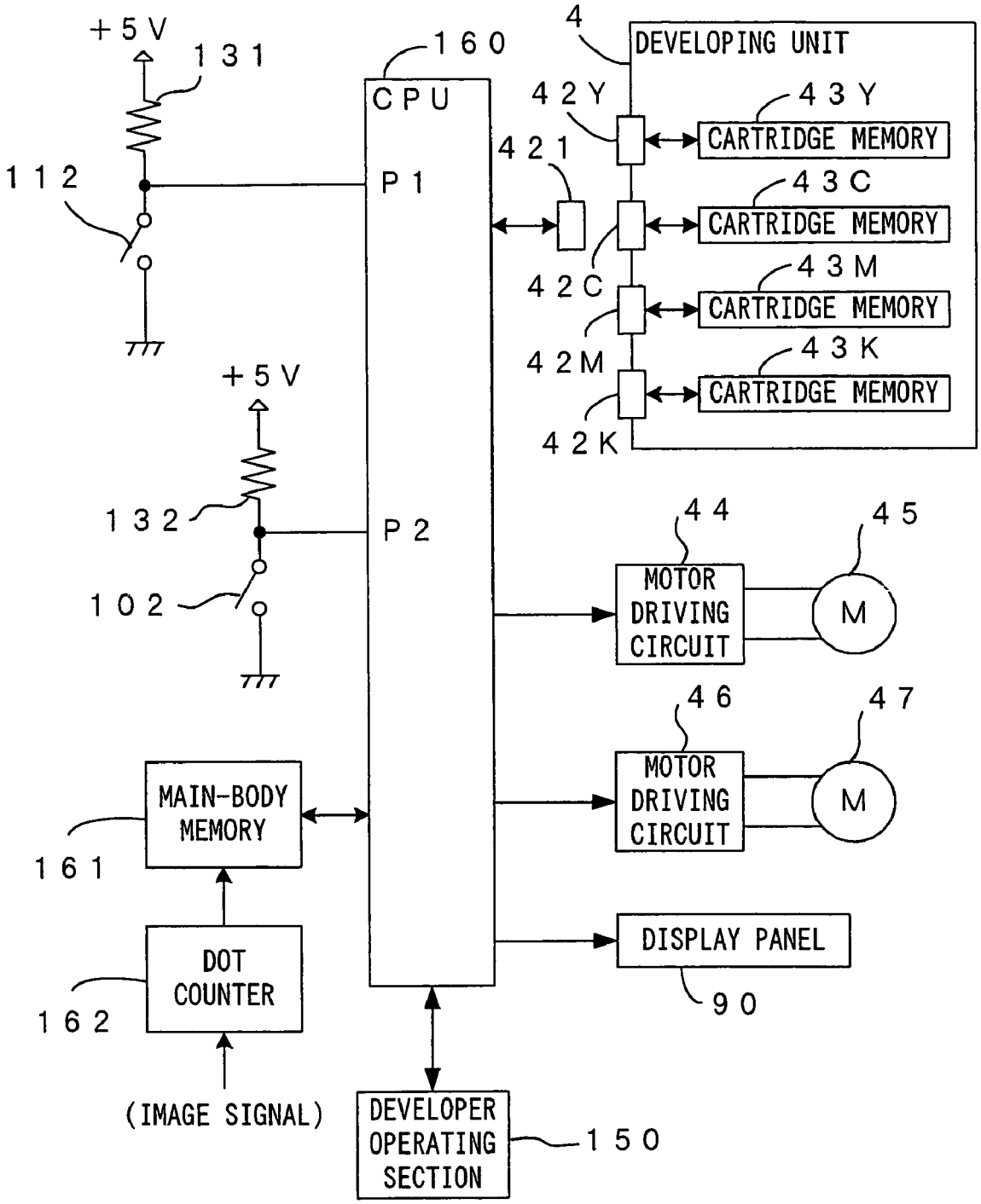
FIG. 5 is a diagram showing an electrical construction of the image forming apparatus of FIG. 1.

FIG. 5 is a diagram showing an electrical construction of this image forming apparatus. In this image forming apparatus, the controller (CPU) 160 for controlling the operations of the respective units is provided as shown in FIG. 5, and the main-body memory 161 and the like are connected therewith. The main-body memory 161 includes a ROM section storing a control program of the CPU 160 and a RAM section for temporarily saving data. Preferably, a nonvolatile memory as described above is used as the main-body memory 161.

A dot counter 162 is connected with this main-body memory 161. This dot counter 162 is adapted to count the number of print dots formed on the photosensitive member 22 for each color in accordance with the image signal inputted from the external apparatus. The number of dots is added up during the image formation. For example, every time one toner image of one color is formed, this cumulative value is saved in the mainbody memory 161. The CPU 160 calculates consumed amounts of the toners of the respective colors based on the cumulative values of the respective colors at a specified timing (for example, when the formation of the toner images of four colors is completed or when a series of image forming operations in accordance with a print command signal inputted from the external apparatus is completed); calculates the remaining amounts of the toners in the respective developers based on the consumed amounts of the toners and saves them in the main-body memory 161. In this embodiment, the remaining amounts of the toners correspond to "life values" of the invention. A known technique (for example, see U.S. Pat. No. 5,635,972, Japanese Unexamined Patent Publications Nos. 2002-162800, 2002-174929) may be used as such a method of calculating the consumed amounts of the toners.

Output signals from the aforementioned limit switches 102, 112 are inputted to the CPU 160. More specifically, the limit switch 112 for detecting the open and closed states of the inner cover 110 is connected with the other end of a pull-up resistor 131 having one end thereof connected with a power source. On the other hand, the limit switch 102 for detecting the open and closed states of the outer cover 100 is connected with the other end of a pull-up resistor 132 having one end thereof connected with the power source. The other ends of these pull-up resistors 131, 132 are connected with input ports P1, P2 of the CPU 160.

Thus, the CPU 160 can discriminate the states of the inner cover 110 and the outer cover 100 based on levels of voltages inputted to the two input ports P1, P2. Specifically, the following discriminations can be made.

(First State)

H-level at the port P1: The inner cover 110 is open.

(Second State)

L-level at the port P1: The inner cover 110 is closed.

(Third State)

H-level at the port P2: The outer cover 100 is open.

(Fourth State)

L-level at the port P2: The outer cover 100 is closed.

Based on the discrimination result, the CPU 160 judges whether or not to permit the rotation of the developing unit 4. Specifically, the rotation of the developing unit 4 is permitted when both the outer cover 100 and the inner cover 110 are closed. When the rotation is permitted, the CPU 160 outputs a control command to the motor driving circuit 46 to position the developing unit 4 to a specified position if necessary. In response to this control command, the motor driving circuit 46 outputs a drive pulse having a specified pulse number to a stepping motor 47 for rotating the developing unit 4. It should be noted that the apparatus main body 1 is provided with a home position sensor (not shown) for detecting the home position of the developing unit 4, and the developing unit 4 is positioned to the specified position based on a detection signal from this home position sensor and the above pulse number.

As described above, when the closed outer cover 100 is opened, the developing unit 4 is positioned to the home position and waits on standby. If the image forming operation is being performed at this time, this operation is immediately stopped. In this state, the rotation of the developing unit 4 is not prohibited and it is waited until the developer operating section 150 is operated as described later. When the closed inner cover 110 is opened in this state, the rotation of the developing unit 4 is prohibited. If the developing unit 4 is being rotated at this time, this rotation is immediately stopped, thereby avoiding the trouble of the developing unit 4. In this embodiment, the limit switch 112 corresponds to a "detecting means" of the invention, the motor driving circuit 46 and the stepping motor 47 correspond to a "driving means" of the invention, and the CPU 160 corresponds to a "drive controlling means" of the invention.

The CPU 160 is also provided with a function as a mode controlling means for controlling operation modes of the image forming apparatus. A standby mode is entered after a specified initialization is carried out when the apparatus is turned on; an image formation mode is entered when a print command signal is inputted from the external apparatus; the standby mode is entered when the outer cover 100 is opened; and a cartridge exchange mode is entered when any of the developer operating buttons 151Y, 151C, 151M, 151K is pressed in the standby mode.

In the first preferred embodiment, the CPU 160 performs the reading and writing from and in the cartridge memory 43Y, 43C, 43M, 43K only at the time of detaching the developer 4Y, 4C, 4M, 4K in view of how often the rewriting can be made to the cartridge memories 43Y, 43C, 43M, 43K until the lives thereof end, how often the main-body side connector 421 and the developer side connectors 42Y, 42C, 42M, 42K can be connected until the lives thereof end, and how often the drawer motor 45 can be driven until the life thereof ends.

It is conceivable that the developers 4Y, 4C, 4M, 4K are improperly detached from the apparatus main body 1 at the following timings. Since the developing unit 4 is rotated in the rotating direction D5 of FIG. 3A in this image forming apparatus, the developer 4Y reaches the reading/writing position (see FIG. 3B) after passing the detachment position (see FIG. 3C) if the developer operating button 151Y is turned on to enter the cartridge exchange mode with the developing unit 4 located at the home position (see FIG. 3A). Accordingly, if the inner cover 110 is opened when the developer 4Y reaches the detachment position by the rotation of the developing unit 4, the rotation of the developing unit 4 is immediately stopped as described above, thereby making it possible to improperly detach the developer 4Y Upon such an improper detachment, an amount of the toner actually remaining in the developer 4Y is less than the remaining amount of the toner saved in the cartridge memory 43Y. Thus, if this developer 4Y is mounted again later, the remaining amount of the toner in the cartridge memory 43Y is read and the life administration is made based on this data, image failures such as indistinct or blurred images may occur before the exhaustion of the toner is detected.

In view of the above, using specific areas of the cartridge memories 43Y, 43C, 43M, 43K, the CPU 160 writes an improper detachment flag in the specific area of the cartridge memory 43Y, 43C, 43M, 43K when the developer 4Y, 4C, 4M, 4K is mounted into the apparatus main body 1, and clears the improper detachment flag before the developer 4Y, 4C, 4M, 4K is detached from the apparatus main body 1 when the developer operating button 151Y, 151C, 151M, 151K is pressed. In this way, the improper detachment of the developers 4Y, 4C, 4M, 4K from the apparatus main body 1 is made recognizable. Thus, in this embodiment, the CPU 160 corresponds to a "first main-body controlling means" of the invention, and the improper detachment flag corresponds to "improper detachment information for making an improper detachment of the developer cartridge from the apparatus main body recognizable" of the invention. This operation is described in detail later.

Here, the "improper detachment of the developer cartridge from the apparatus main body" means a detachment of the developer 4Y, 4C, 4M, 4K from the apparatus main body 1 without executing a specified procedure: for example, a detachment of the developer without any instruction to exchange, e.g. during a power failure and a detachment of the developer without renewably writing the latest data of the information on the life in the cartridge memory 43Y, 43C, 43M, 43K.

Figure 6:
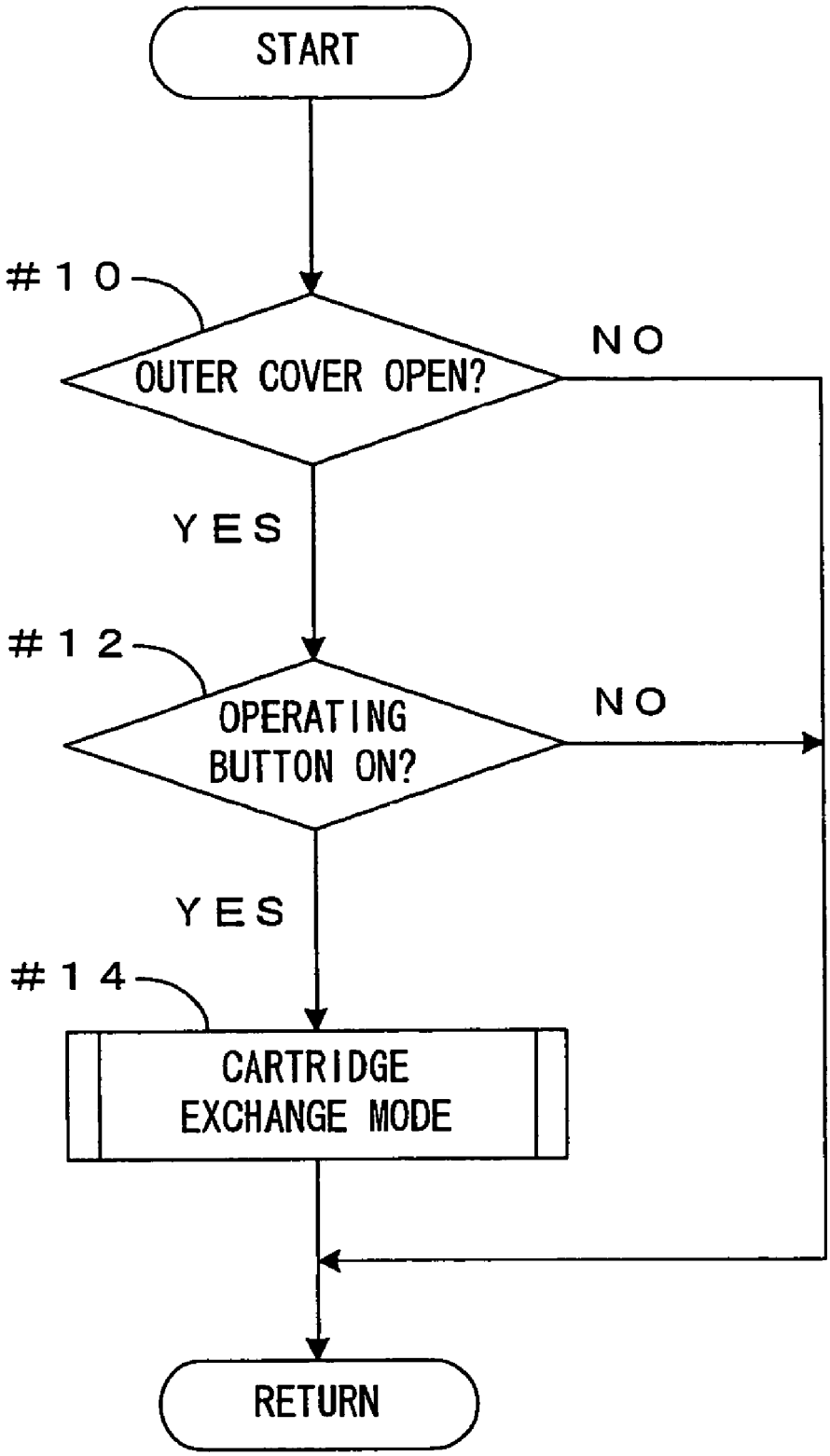
FIG. 6 is a flow chart showing a procedure of entering a cartridge exchange mode.
Figure 7:
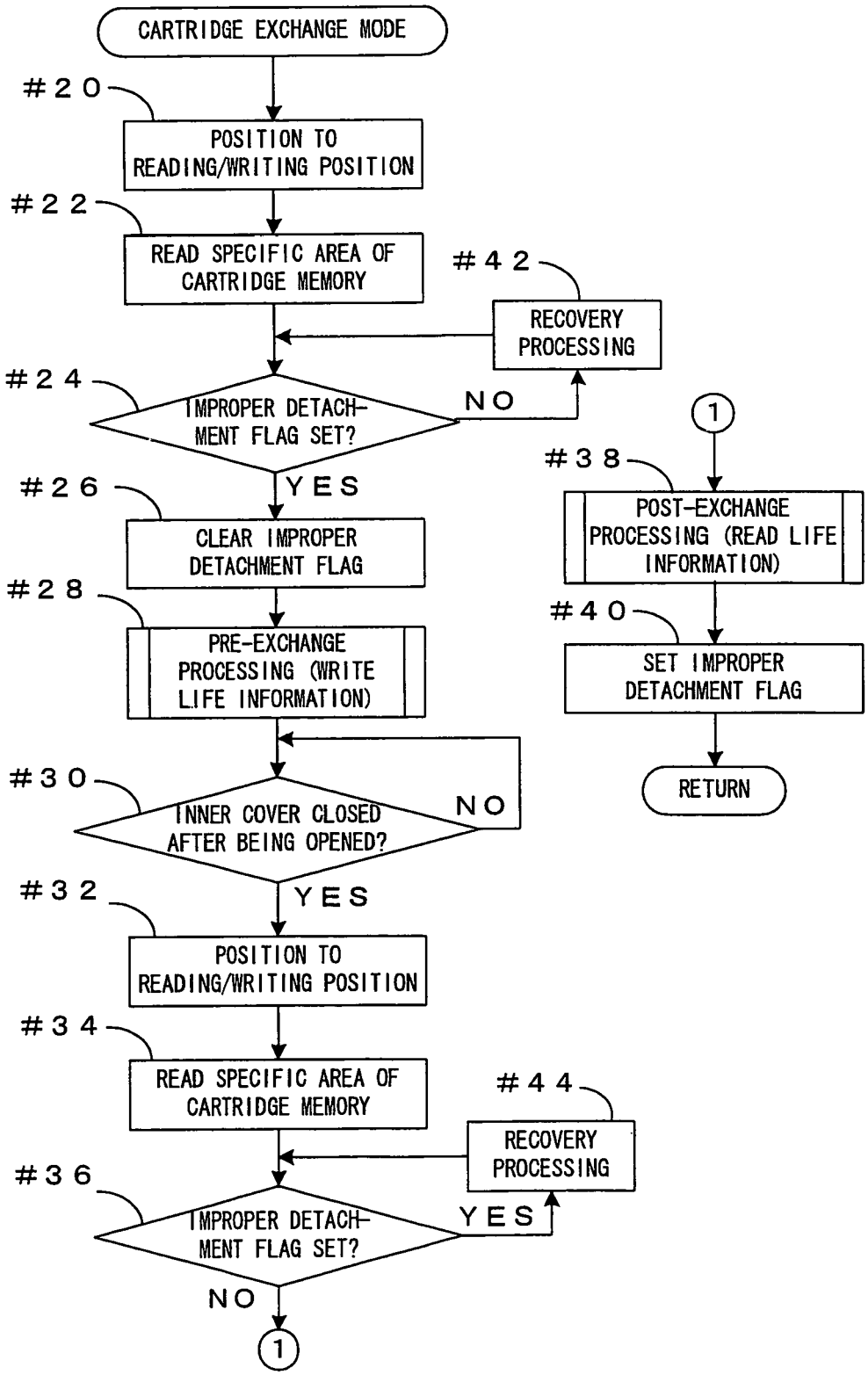
FIG. 7 is a flow chart showing a procedure of the cartridge exchange mode.

FIG. 6 is a flow chart showing a procedure of entering the cartridge exchange mode, and FIG. 7 is a flow chart showing a procedure of the cartridge exchange mode. The CPU 160 executes the procedure of FIG. 6 at a specified interval (e.g. 30 msec.). In FIG. 6, the state of the outer cover 100 is first discriminated based on the voltage level of the port P2 (Step #10). Here, if the port P 2 is at L-level, i.e. the outer cover 100 is closed as shown in the above (Fourth State) (NO in Step #10), this routine is ended. On the other hand, if the port P2 is at H-level, i.e. the outer cover 100 is open as shown in the above (Third State) (YES in Step #10), whether or not any of the developer operating buttons 151Y, 151C, 151M, 151K of the developer operating section 150 has been turned on is discriminated (Step #12). If none of the developer operating buttons 151Y, 151C, 151M, 151K has been turned on (NO in Step #12), this routine is ended. Specifically, while the outer cover 100 is open, it is waited until any of the developer operating buttons 151Y, 151C, 151M, 151K is operated. If any of the developer operating buttons 151Y, 151C, 151M, 151K is turned on (YES in Step #12), the cartridge exchange mode is entered (Step #14). Although a case where the developer operating button 151Y is turned on is described as an example below, the operation is performed in a similar procedure even if the other developer operation button 151C, 151M, 152K is turned on.

Upon entering the cartridge exchange mode, the developing unit 4 is first rotated to position the developer side connector 42Y of the developer 4Y to be detached to the position facing the main-body side connector 421 (see FIG. 3B) as shown in FIG. 7, whereby the developing unit 4 is positioned to the reading/writing position (developing position) (Step #20). Subsequently, the drawer motor 45 is driven to connect the developer side connector 42Y and the main-body side connector 421, whereupon the specific area of the cartridge memory 42Y is read (Step #22) and whether or not the improper detachment flag is set is discriminated (Step #24). If the improper detachment flag is set (YES in Step #24), a specified pre-exchange processing including an operation of renewably writing the information on the life saved in the cartridge memory 42Y as the remaining amount of the toner in the main body memory 161 is executed (Step #28) after this flag is cleared (reset) (Step #26).

Subsequently, whether or not the inner cover 110 has been opened and closed is discriminated (Step #30). This image forming apparatus is not provided with any physical sensor for detecting the presence or absence of the developers 4Y, 4C, 4M, 4K in the supporting frame 40. This detection is made based on the presence or absence of the developer side connector 42Y, 42C, 42M, 42K to be connected with the main-body side connector 421 at the reading/writing position. Accordingly, in this embodiment, the developer 4Y is assumed to have been mounted until the inner cover 110 is closed after it was opened with the developing unit 4 located at the detachment position. When the inner cover 110 is closed (YES in Step #30), succeeding Step #32 follows.

In Step #32, the developing unit 4 is positioned to the reading/writing position (developing position), so that the developer side connector 42Y of the developer 4Y that was supposed to be mounted in Step #30 is to be located at the position facing the main-body side connector 421 (see FIG. 3B). Then, the drawer motor 45 is driven to connect the developer side connector 42Y and the main-body side connector 421, whereupon the specific area of the cartridge memory 43Y is read (Step #34) and whether or not the improper detachment flag is set is discriminated (Step #36). If the improper detachment flag is not set (NO in Step #36), the improper detachment flag is set in the specific area of the cartridge memory 43Y and the developing unit 4 is positioned to the home position (Step #40), thereby ending the cartridge exchange mode, after a specified post-exchange processing including an operation of reading the information on the life saved in the cartridge memory 43Y and writing it in the main-body memory 161 is executed (Step #38).

On the other hand, if the improper detachment flag is not set in Step #24 (NO in Step #24), this developer 4Y is thought to be a developer mounted in place of the one having been improperly detached. Accordingly, a permanent loop is entered to execute a recovery processing (Step #42). This recovery processing may be, for example, such that a message stating that the developer was mounted in place of the improperly detached developer is displayed on the display panel 90 to notify it to the user or that a service-person call requiring the maintenance by a service person may be given.

If the improper detachment flag is set in Step #36 (YES in Step #36), the developer Y is thought to be a developer having been improperly detached from the apparatus main body 1 without erasing the improper detachment flag before. Accordingly, the permanent loop is entered to execute a recovery processing (Step #44). This recovery processing may be, for example, such that a message stating that this developer was improperly detached from the apparatus main body 1 before is displayed on the display panel 90 to notify it to the user or that a service-person call requiring the maintenance by a service person may be given. Thus, in this embodiment, the recovery processings in Steps #42 and #44 correspond to an "abnormality processing" of the invention.

As described above, in the first preferred embodiment, when the user instructs the exchange of the developer 4Y, 4C, 4M, 4K by operating the developer operating section 150, the latest data on the remaining amount of the toner (information on the life) saved in the main-body memory 161 is written in the cartridge memory 43Y, 43C, 43M, 43K before the developing unit 4 is positioned to the detachment position to locate the developer 4Y, 4C, 4M, 4K in the developer opening 115, enabling the detachment. Thus, the life of the developer 4Y, 4C, 4M, 4K can be precisely administered using the information on the life read from the cartridge memory 43Y, 43C, 43M, 43K when this developer 4Y, 4C, 4M, 4K is mounted again. Therefore, for example, upon mass printing, the developers 4Y, 4C, 4M, 4K can be used as follows. Any developer 4Y, 4C, 4M, 4K being used and containing a small amount of the toner is temporarily detached and stored. After a new developer 4Y, 4C, 4M, 4K is mounted and mass printing is carried out, the new developer 4Y, 4C, 4M, 4K is detached and the stored old one containing a small amount of the toner is mounted again. In this way, the convenience of the apparatus can be improved.

In this embodiment, the improper detachment flag is written (set) in the cartridge memory 43Y, 43C, 43M, 43K when the developer 4Y, 4C, 4M, 4K is mounted into the apparatus main body 1, and cleared (reset) before it is detached from the apparatus main body 1. Thus, whether or not the aforementioned improper detachment has been made can be discriminated based on the presence or absence of the improper detachment flag. Specifically, in accordance with the procedure of FIG. 7, the specific area of the cartridge memory 43Y of the developer 4Y to be detached is read to confirm whether or not the improper detachment flag is set (Step #24). Thus, whether or not the developer 4Y has been improperly detached from the apparatus main body 1 and a new developer 4Y has been improperly mounted in place of the improperly detached one can be discriminated.

Further, in accordance with the procedure of FIG. 7, the specific area of the cartridge memory 43Y of the mounted developer 4Y is read to confirm whether or not the improper detachment flag is set (Step #36). Thus, whether or not this developer 4Y is the one that was improperly detached from the apparatus main body 1 before can be discriminated. At this time, it is not necessary to provide separate memories for the writing of the improper detachment flag (improper detachment information) since the improper detachment flag is written in the existing cartridge memories 43Y, 43C, 43M, 43K.

<Modifications of the First Preferred Embodiment>

The present invention is not limited to the foregoing embodiment and various other changes can be made without departing from the scope thereof. For example, in the first preferred embodiment, the improper detachment flag is used as the improper detachment information and the improper detachment flag is set in the specific areas of the cartridge memories 43Y, 43C, 43M, 43K as an example of writing the improper detachment information in the cartridge memories 43Y, 43C, 43M, 43K. However, the improper detachment information is not limited to the above. For example, the intrinsic information saved in the cartridge memories 43Y, 43C, 43M, 43K may be rewritten into information that cannot exist, and this information that cannot exist may be used as the improper detachment information. In the case of saving the contained amount of the toner as the information on the life, the contained amount of the toner may be rewritten into 0, 1 or like value it cannot take, and it may be judged that the improper detachment information is written if the contained amount of the toner is 0 (or 1) when the cartridge memory 43Y, 43C, 43M, 43K is read. For example, in the case of saving the driven hours of the developer as the information on the life, the driven hours may be rewritten into 100,000 hours or such a value that cannot be true. Further, in the case of saving the production date as the intrinsic information, the production date may be rewritten into such a fictitious month other than January through December. With these arrangements as well, the image forming apparatus can operate similar to the first preferred embodiment.

Although the reading and writing from and in the cartridge memory 43Y, 43C, 43M, 43K are performed when the developer 4Y, 4C, 4M, 4K is detached in the first preferred embodiment, the invention is not limited thereto. For example, the CPU 160 may read and write the information in the cartridge memories 43Y, 43C, 43M, 43K at a specified timing (when the apparatus is turned on in this modification) in addition to the detachment timing (during the cartridge exchange mode).

The reason why the reading and writing from and in the cartridge memory 43Y, 43C, 43M, 43K are performed at the specified timing in addition to the period of the cartridge exchange mode is described below. If a CPU of an apparatus main body is so constructed as to discontinuously read and write information from and in a cartridge memory as in the foregoing embodiment instead of being constantly connected with the cartridge memory to enable the reading and writing at any time, a remaining amount of a toner actually contained in a developer does not agree with a remaining amount of the toner saved in the cartridge memory until information on the life (e.g. remaining amount of the toner) saved in the cartridge memory is updated to the latest data.

The improper detachment of the developer from the apparatus main body 1 does not necessarily occur during the cartridge exchange mode as described in the first preferred embodiment. For example, the improper detachment of the developer (e.g. developer 4Y) are possible if the developing unit 4 accidentally stops at the detachment position (or position where the developer can be detached through the developer opening 115) when the power supply is suddenly shut off, for example, due to a power failure. In such a case, the CPU 160 cannot detect the opening and closing operations of the inner cover 110 since there is no power supply. An initial amount of the toner should be contained in a developer improperly mounted in place of the improperly detached developer 4Y. However, since the remaining amount of the toner in the improperly detached developer is kept saved as the life information in the main-body memory 161, the exhaustion of the toner is detected despite the toner still residual in the developer if the life administration is carried out based on this data. In other words, the exchange of the developer is requested to the user with a sufficient amount of the toner still left in the developer. Further, if this improperly mounted developer is kept used and is then improperly detached, it is detached from the apparatus main body 1 without setting the improper detachment flag. Accordingly, in this modification, the reading and writing from and in the cartridge memory are performed when the apparatus is turned on, whereby the improper detachment of the developer while the apparatus was off can be discriminated. Thus, in this modification, a "storage controlling condition" of the invention is satisfied when the user turns the image forming apparatus on.

Figure 8:
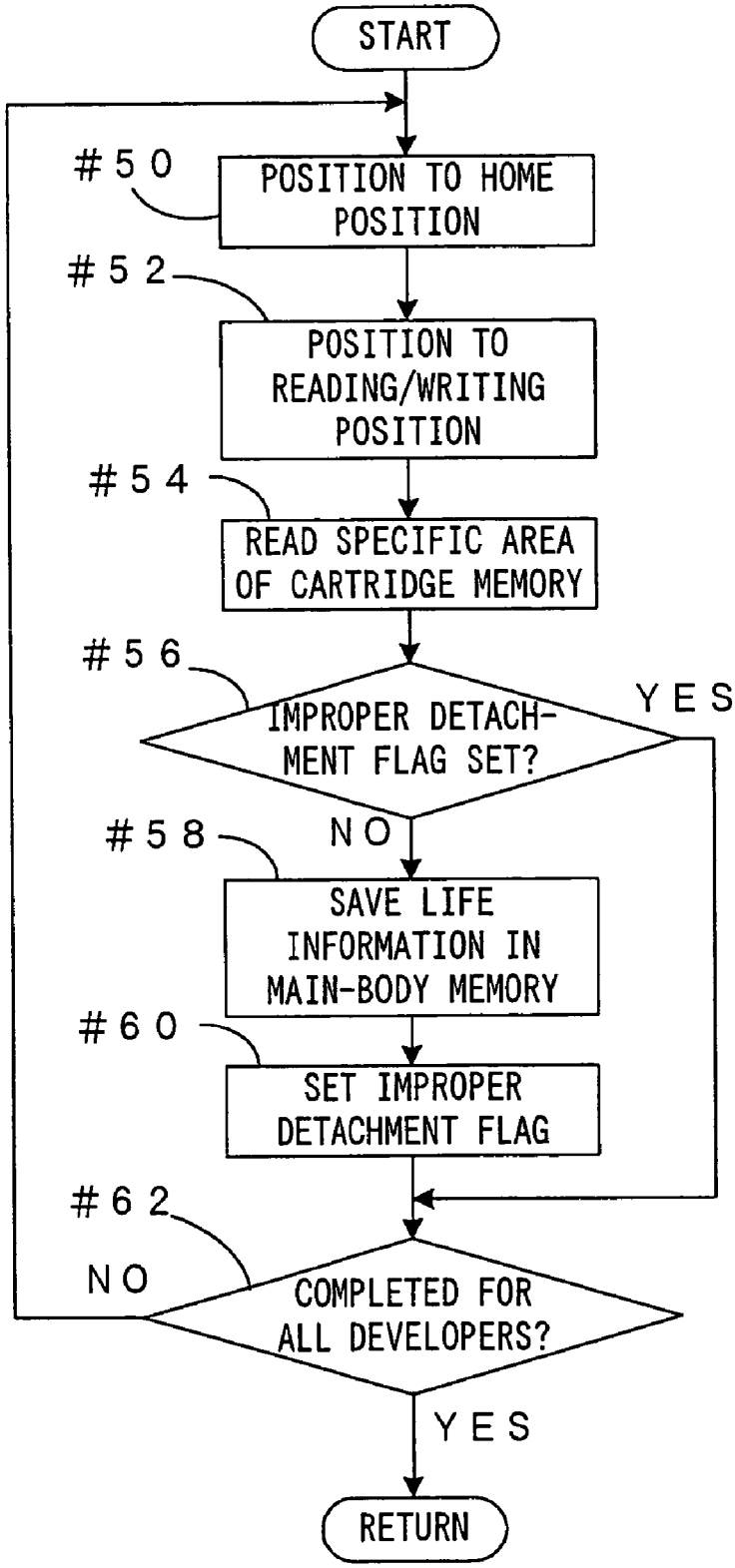
FIG. 8 is a flow chart showing a procedure of reading and writing information from and in a cartridge memory according to a modification of the first preferred embodiment.

FIG. 8 is a flow chart showing a procedure of reading and writing the information from and in the cartridge memory when the apparatus is turned on. In FIG. 8, when the apparatus is turned on, the developing unit 4 is first positioned to the home position (Step #50), whereby the pulse number of the stepping motor 47 for driving the developing unit 4 is reset. Subsequently, one developer (e.g. developer 4Y) is positioned to the reading/writing position (Step #52); the specific area of the cartridge memory 43Y is read (Step #54) after the drawer motor 45 is driven to connect the developer side connector 42Y and the main-body side connector 421; and whether or not the improper detachment flag is set is discriminated (Step #56). Unless the improper detachment flag is set (NO in Step #56), it means that this developer 4Y is the one that was improperly mounted in place of the developer improperly detached while the apparatus was off. Accordingly, the improper detachment flag is set in the specific area of the cartridge memory 43Y (Step #60) after the information on the life saved in the cartridge memory 43Y is read and written in the main-body memory 161 (Step #58), and then Step #62 follows.

On the other hand, if the improper detachment flag is set (YES in Step #56), it means that no improper detachment was made while the apparatus was off. Accordingly, Steps #50 to #60 are repeated until the reading and writing are performed for all the developers (NO in Step #62). When the reading from the cartridge memories of all the developers is completed (YES in Step #62), this routine is ended to enter the usual initialization executed when the apparatus is turned on.

As described above, according to this modification, the cartridge memories 43Y, 43C, 43M, 43K are read when the apparatus is turned on, and the improper detachment flag is set if it is not set. Thus, even if the developers are improperly detached, they can be prevented from being detached from the apparatus main body 1 without setting the improper detachment flag. Further, unless the improper detachment flag is set, the information on the life is read and saved in the main-body memory 161. Thus, the lives of the developers can be precisely administered.

Specifically, if the information written in the cartridge memories 43Y, 43C, 43M, 43K is read every time the apparatus is turned on, a difference between the amount of the toner contained in the developer 4Y, 4C, 4M, 4K mounted after the improper detachment and the information on the life saved in the main-body memory 161 is suppressed to an amount of the toner consumed for the image formation until the apparatus was turned off after the developer had been mounted. Thus, the life administration can be relatively precisely carried out. Further, since the above difference is null if the improper detachment occurs while the apparatus is off, the life administration can be precisely carried out in such a case.

In this modification, the information is read from the cartridge memories when the apparatus is turned on. However, the procedure of FIG. 8 may be executed at other timings in place of or in addition to the timing of turning the apparatus on. This is because the improper detachment of the developers does not necessarily occur while the apparatus is off.

Figure 9A:
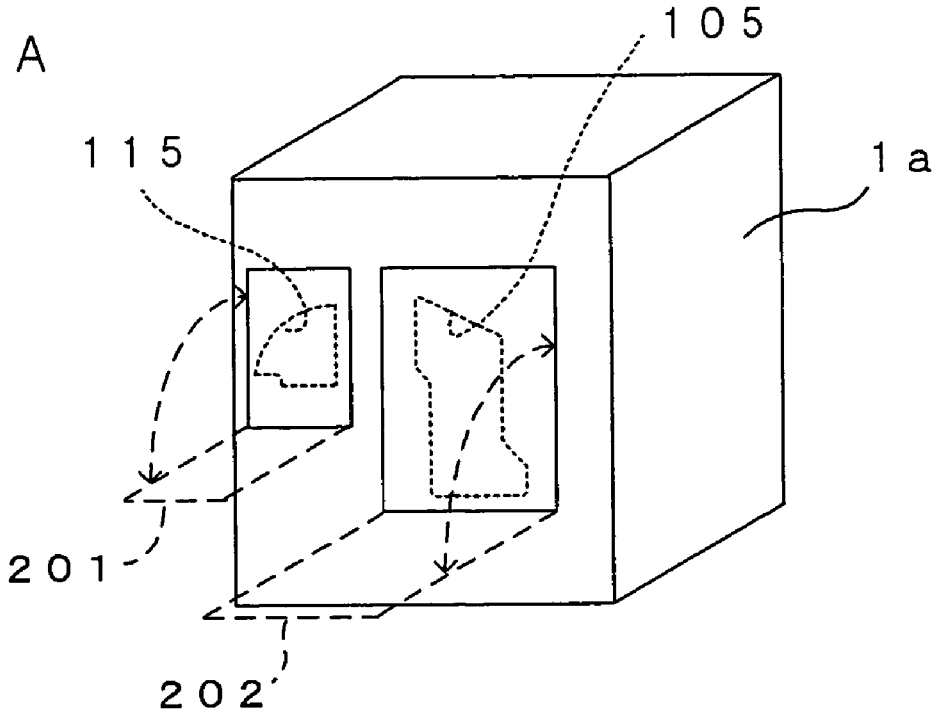
FIGS. 9A and 9B are diagrams showing modifications of the first preferred embodiment.
Figure 9B:
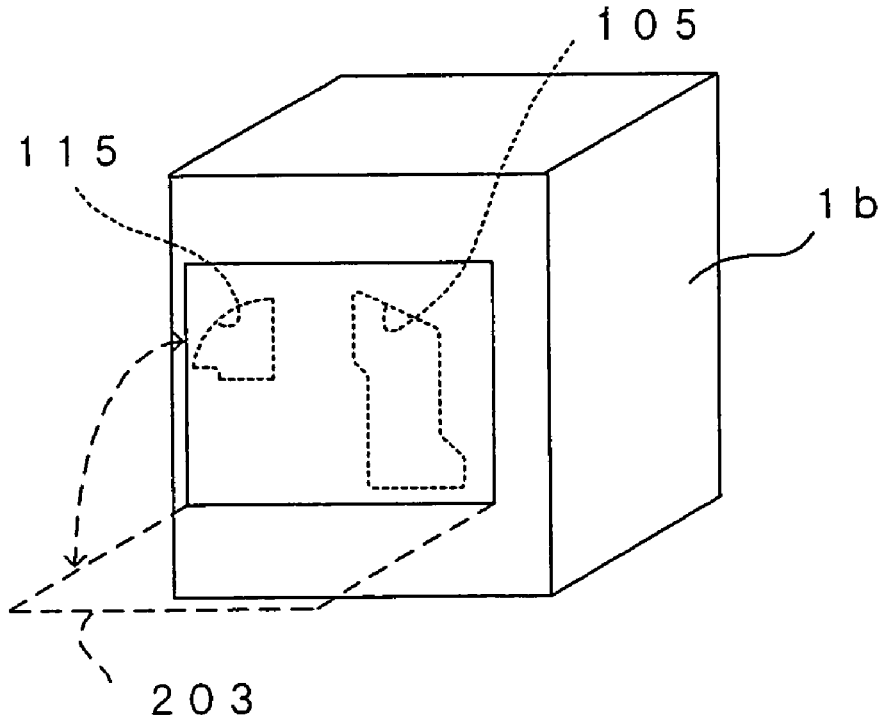

For example, if one developer accidentally stops at the detachment position (or position where the developer can be detached through the developer opening 115) when the inner cover 110 is opened during the movement of the developing unit 4 to the home position following the opening of the outer cover 100, this developer can be improperly detached. Further, in the case of such an exemplary construction as shown in FIG. 9A that a developer cover 201 for covering a developer opening 115 and a photosensitive member cover 202 for covering a photosensitive member opening 105 are independently provided, so that both covers 201, 202 can be opened and closed from the outside of the apparatus main body la, one developer can be improperly detached when the developer cover 201 is opened while the apparatus is on and this developer accidentally stops at a detachment position (position where the developer can be detached through the developer opening 115). Further, in the case of such an exemplary construction as shown in FIG. 9B that an apparatus main body 1*b* is formed with such an outer cover 203 as to cover both developer opening 115 and photosensitive member opening 105, one developer can be improperly detached when the outer cover 203 is opened while the apparatus is on and this developer accidentally stops at a detachment position (position where the developer can be detached through the developer opening 115). In these cases, the same problem as in the foregoing embodiment arises for a developer improperly mounted in place of the improperly detached developer if this developer continues to be used.

Accordingly, the above procedure of FIG. 8 may be executed every time the number of prints made reaches a specified value. With such an arrangement, the information on the life is read before a specified number of prints are made, even if the aforementioned improper detachment should occur. Therefore, an occurrence of a large error in the life administration can be avoided.

Specifically, if the information written in the cartridge memories 43Y, 43C, 43M, 43K is read every time the specified number of prints are made, a difference between the amount of the toner contained in the developer 4Y, 4C, 4M, 4K mounted after the improper detachment and the information on the life saved in the main-body memory 161 is, at maximum, an amount of the toner consumed for the specified number of image formations. Thus, the life administration can be relatively precisely carried out. It should be noted that the specified number may be set at a suitable value that does not lead to such a large error as to hinder the life administration. Thus, in this modification, the "storage controlling condition" of the invention is satisfied when the number of prints reaches the specified number.

Further, if the mechanism for reading the cartridge memories is of the aforementioned noncontacting type and no operation step is necessary for the reading or the life administration is desired to be strictly carried out even with the presence of operation steps, the procedure of FIG. 8 may be executed every time a series of image forming operations in accordance with a print command signal inputted form the external apparatus are performed. According to this modification, the information of the life can be read every time a series of image forming operations are performed even if the aforementioned improper mounting occurs. Thus, there is an advantage of hardly any error in the life administration. Thus, in this modification, the "storage controlling condition" of the invention is satisfied upon the input of a print command signal from the external apparatus.

In this case, the procedure of FIG. 8 executed every time a series of image forming operations are performed may be executed before the start of the image formation or after the completion of the image formation. If it is executed before the start of the image formation, the throughput of the image formation is reduced, but the amount of the toner contained in the developer 4Y, 4C, 4M, 4K mounted after the improper detachment and the information on the life saved in the main-body memory 161 substantially agree. Thus, there is an advantage of the precise life administration. On the other hand, if this procedure is executed after the completion of the image formation, there is a difference between the amount of the toner contained in the developer 4Y, 4C, 4M, 4K mounted after the improper detachment and the information on the life saved in the main-body memory 161 by an amount of the toner consumed during the image forming operations, but there is an advantage of no reduction in the throughput of the image formation.

Second Preferred Embodiment

Next, a second preferred embodiment of the image forming apparatus according to the invention is described. The construction of the image forming apparatus of the second preferred embodiment is substantially the same as that of the first preferred embodiment described with reference to FIGS. 1 to 5. The second preferred embodiment partly differs from the first preferred embodiment in its construction and operation, and the following description is centered on different points.

In this second preferred embodiment, the CPU 160 reads and writes information from and in the cartridge memories 43Y, 43C, 43M, 43K only during the cartridge exchange mode in view of how often rewriting can be made to the cartridge memories 43Y, 43C, 43M, 43K until the lives of the cartridge memories 43Y, 43C, 43M, 43K end, how often the main-body side connector 421 and the developer side connectors 42Y, 42C, 42M, 42K can be connected until the lives of these connectors end, and how often the drawer motor 45 can be driven until the life thereof ends.

As described in the first preferred embodiment, it is conceivable that the developers 4Y, 4C, 4M, 4K are improperly detached from the apparatus main body 1 at the following timings. Specifically, since the developing unit 4 is rotated in the rotating direction D5 of FIG. 3A in this image forming apparatus, the developer 4Y reaches the reading/writing position (see FIG. 3B) after passing the detachment position (see FIG. 3C) if the developer operating button 151Y is turned on to enter the cartridge exchange mode with the developing unit 4 located at the home position (see FIG. 3A). Accordingly, if the inner cover 110 is opened when the developer 4Y reaches the detachment position by the rotation of the developing unit 4, the rotation of the developing unit 4 is immediately stopped as described above, thereby making it possible to improperly detach the developer 4Y. Upon such an improper detachment, an amount of the toner actually remaining in the developer 4Y is less than the remaining amount of the toner saved in the cartridge memory 43Y Thus, if this developer 4Y is mounted again later, the remaining amount of the toner in the cartridge memory 43Y is read and the life administration is made based on this data, image failures such as indistinct or blurred images may occur before the exhaustion of the toner is detected.

In view of the above, using specific areas of the cartridge memories 43Y, 43C, 43M, 43K, the CPU 160 writes an exchange completion flag in the specific area of the cartridge memory 43Y, 43C, 43M, 43K when the developer 4Y, 4C, 4M, 4K is mounted into the apparatus main body 1, and clears the exchange completion flag before the developer 4Y, 4C, 4M, 4K is detached from the apparatus main body 1 when the developer operating button 151Y, 151C, 151M, 151K is pressed. In this way, the improper detachment of the developers 4Y, 4C, 4M, 4K from the apparatus main body 1 is made recognizable. Thus, in this embodiment, the CPU 160 corresponds to a "second main-body controlling means" of the invention, and the exchange completion flag corresponds to "exchange completion information indicating that the exchange has been normally completed" of the invention. This operation is described in detail later.

Here, "that the exchange of the developer cartridge was properly completed" means that the detachment of the developer 4Y, 4C, 4M, 4K from the apparatus main body 1 and the mounting of the developer 4Y, 4C, 4M, 4K in place of the detached developer 4Y, 4C, 4M, 4K were carried out in specified procedures during the cartridge exchange mode. For instance, it means that the intrinsic information such as the information on the life was properly read and written from and in the cartridge memory 43Y, 43C, 43M, 43K.

Figure 10:
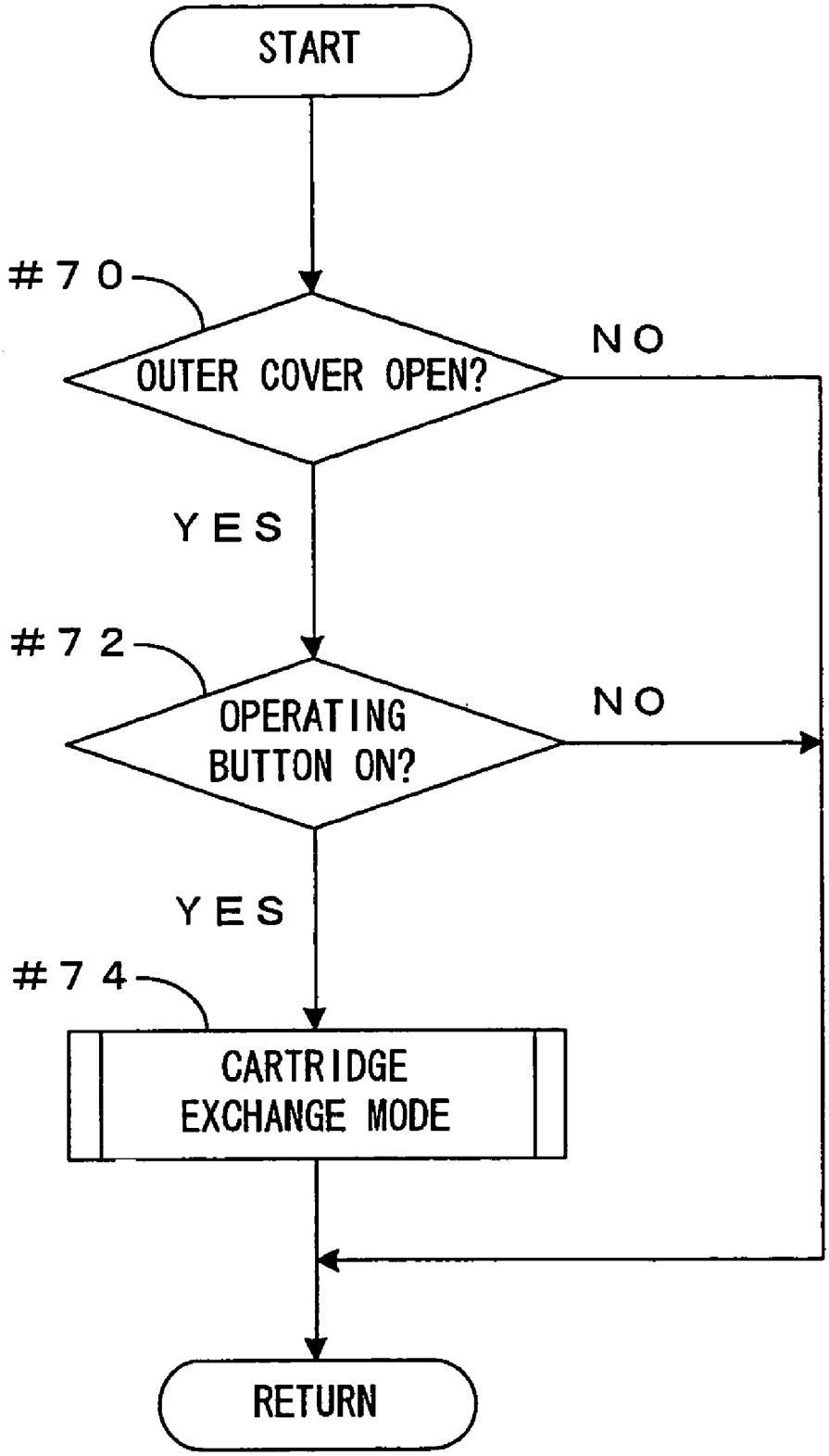
FIG. 10 is a flow chart showing a procedure of entering a cartridge exchange mode in a second preferred embodiment of the image forming apparatus of the invention.
Figure 11:
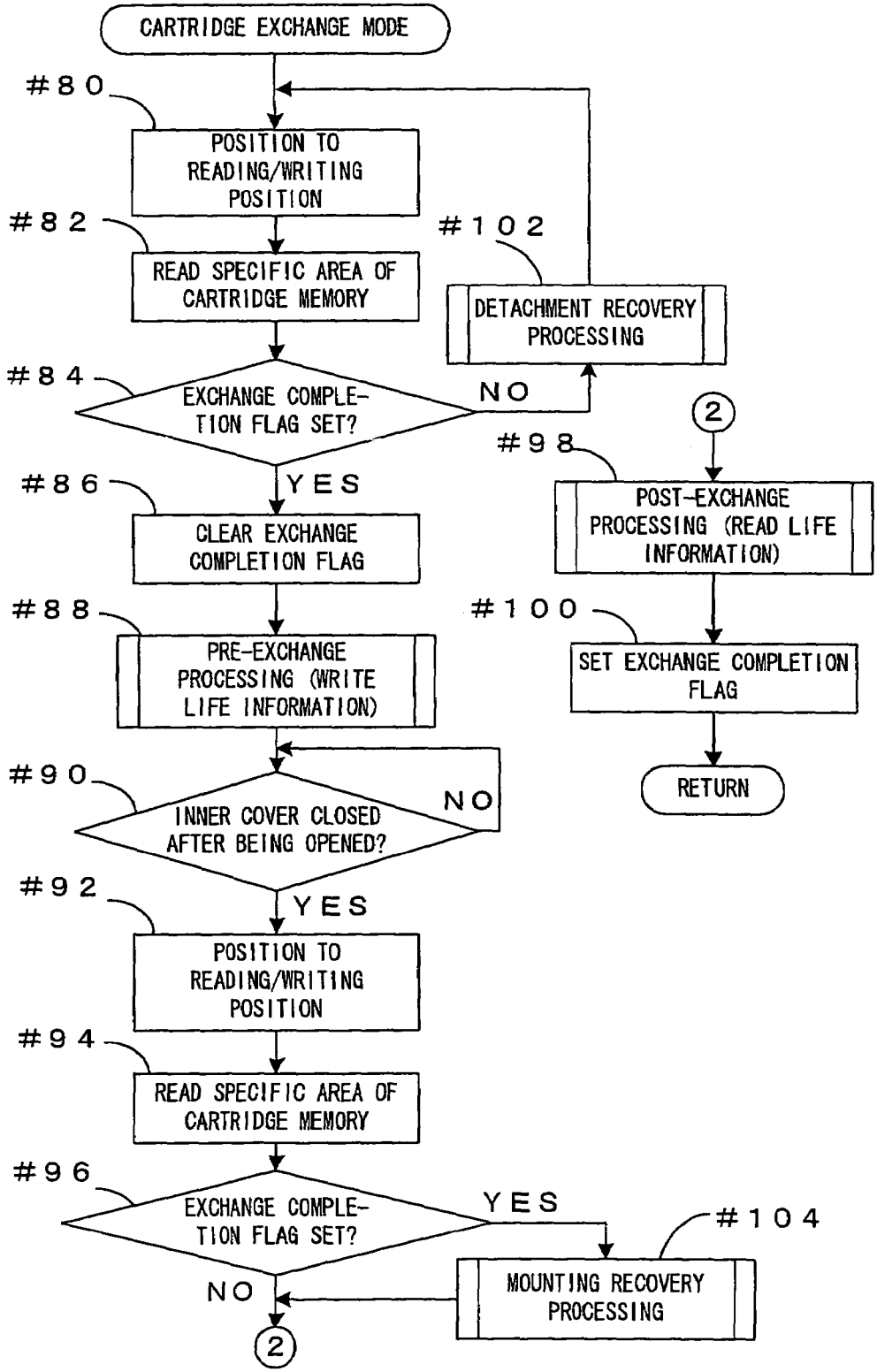
FIG. 11 is a flow chart showing a procedure of the cartridge exchange mode.
Figure 12:
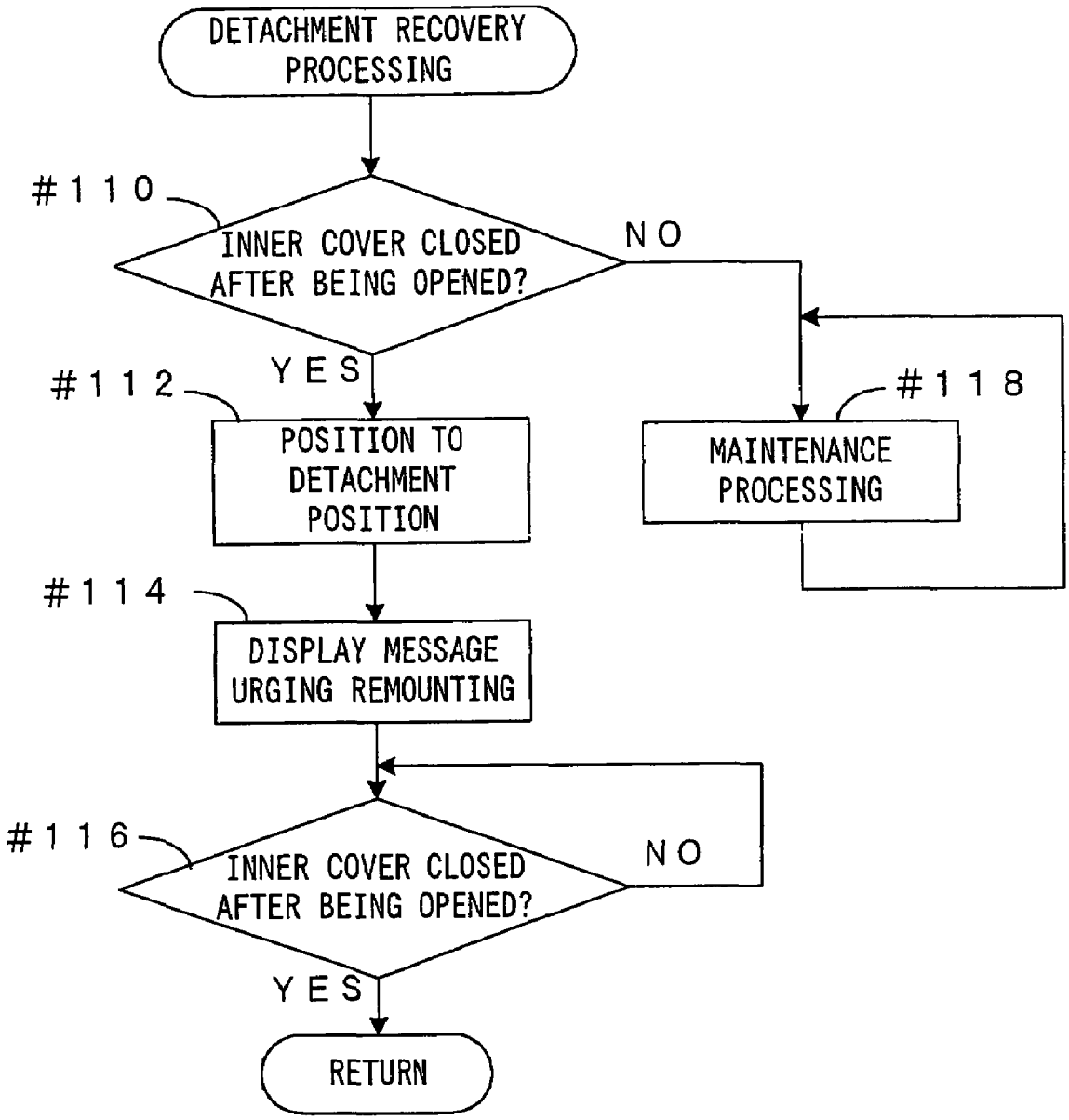
FIG. 12 is a flow chart showing a procedure of a detachment recovery processing.
Figure 13:
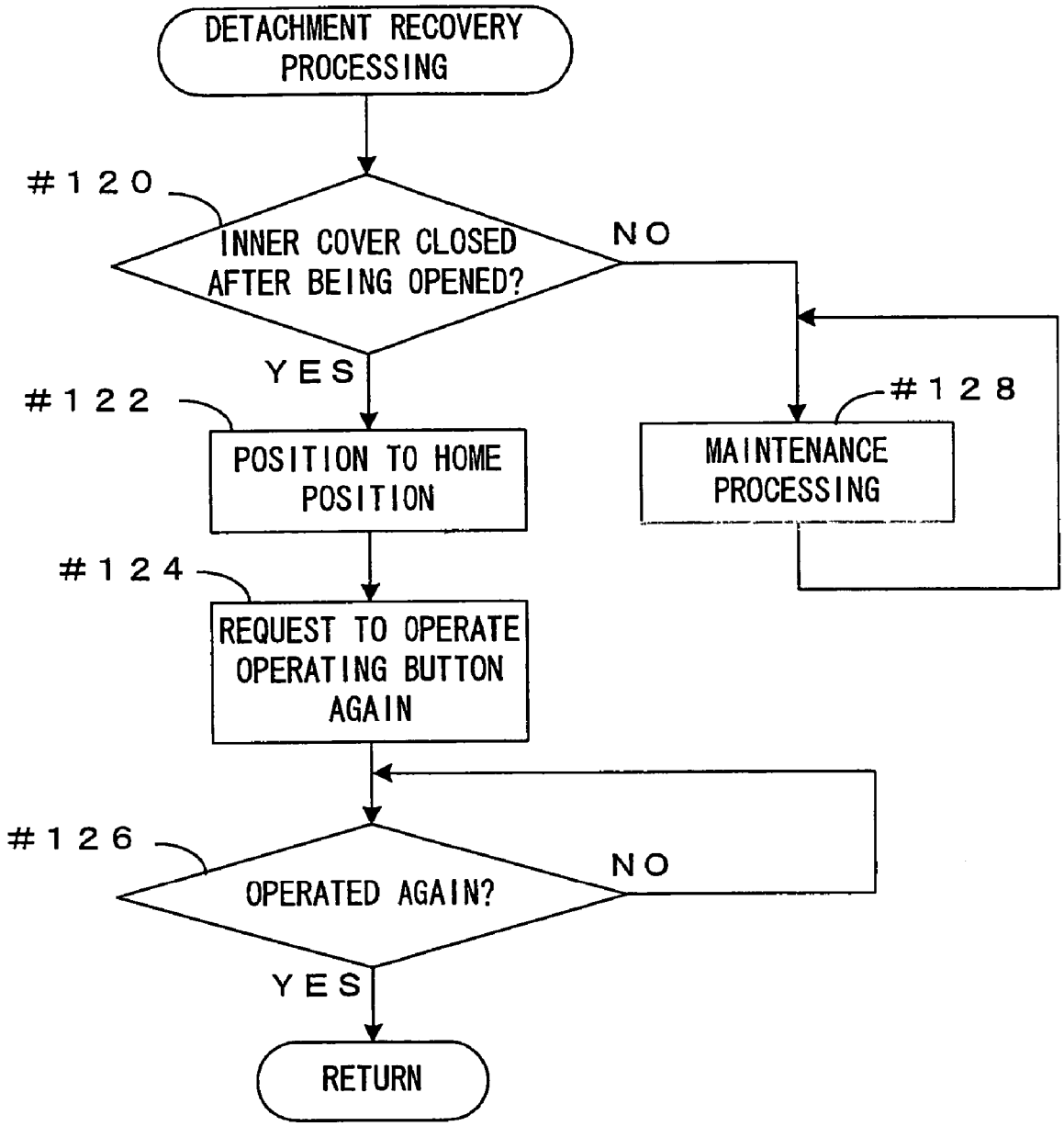
FIG. 13 is a flow chart showing another procedure of the detachment recovery processing.
Figure 14:
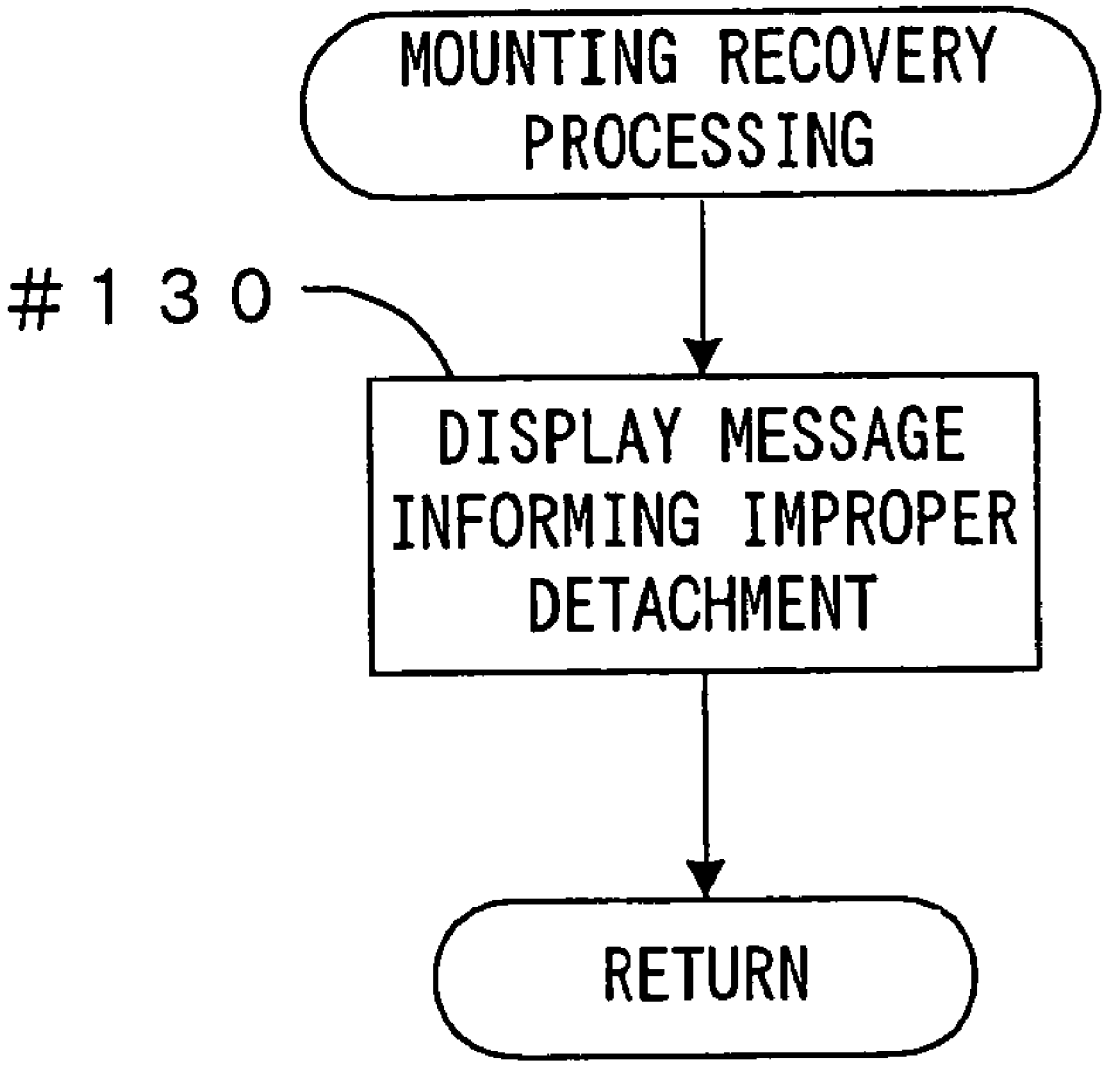
FIG. 14 is a flow chart showing a procedure of a mounting recovery processing.

FIG. 10 is a flow chart showing a procedure of entering the cartridge exchange mode; FIG. 11 is a flow chart showing a procedure of the cartridge exchange mode; FIG. 12 is a flow chart showing a procedure of a detachment recovery processing; FIG. 13 is a flow chart showing another procedure of the detachment recovery processing; and FIG. 14 is a flow chart showing a procedure of a mounting recovery processing. The CPU 160 executes the procedure of FIG. 10 at a specified interval (e.g. 30 msec.).

The procedure of FIG. 10 is similar to that of FIG. 6 of the first preferred embodiment. Specifically, the state of the outer cover 100 is first discriminated based on the voltage level at the port P2 (Step #70). Here, if the port P2 is at L-level, i.e. the outer cover 100 is closed as shown in the above (Fourth State) (NO in Step #70), this routine is ended. On the other hand, if the port P2 is at H-level, i.e. the outer cover 100 is open as shown in the above (Third State) (YES in Step #70), whether or not any one of the developer operating buttons 151Y, 151C, 151M, 151K of the developer operating section 150 has been turned on is discriminated (Step #72). If none of the developer operating buttons 151Y, 151C, 151M, 151K of the developer operating section 150 has been turned on (NO in Step #72), this routine is ended. Specifically, it is waited on standby until the developer operating button 151Y, 151C, 151M, 151K is operated while the outer cover 100 is open. When any one of the developer operating buttons 151Y, 151C, 151M, 151K is turned on (YES in Step #72), the cartridge exchange mode is entered (Step #74). Although a case where the developer operating button 151Y is turned on is described below as an example, operations are performed in a similar procedure also when the other developer operating button 151C, 151M, 151K is turned on.

Upon entering the cartridge exchange mode, the developing unit 4 is first rotated to the reading/writing position (developing position) so that the developer side connector 42Y of the developer 4Y to be detached comes to be located at a position facing the main-body side connector 421 (see FIG. 3B) (Step #80) as shown in FIG. 11. Subsequently, the specific area of the cartridge memory 43Y is read (Step #82) after the drawer motor 45 is driven to connect the developer side connector 42Y and the main-body side connector 421, and whether or not the exchange completion flag is set is discriminated (Step #84). If the exchange completion flag is set (YES in Step #84), a specified pre-exchange processing including an operation of renewably writing the information on the life saved in the cartridge memory 43Y in the main-body memory 161 as the remaining amount of the toner is executed after the exchange completion flag is cleared (reset) (Step #86) and the developing unit 4 is positioned to the detachment position after this pre-exchange processing (Step #88).

Subsequently, whether or not the inner cover 110 has been closed after being opened is discriminated (Step #90). This image forming apparatus is not provided with any physical sensor for detecting the presence or absence of the developers 4Y, 4C, 4M, 4K in the supporting frame 40, which is judged based on the presence or absence of the developer side connector 42Y, 42C, 42M, 42K at the reading/writing position. Accordingly, in this embodiment, it is assumed that the developer 4Y was mounted until the inner cover 110 was closed (NO in Step #90) after it had been opened with the developing unit 4 located at the detachment position, and succeeding Step #92 follows after the inner cover 110 is closed (YES in Step #90).

In Step #92, the developing unit 4 is positioned to the reading/writing position (developing position) so that the developer side connector 42Y of the developer 4Y that was supposed to be mounted in Step #90 comes to be located at the position facing the main-body connector 421 (see FIG. 3B). Subsequently, the specific area of the cartridge memory 43Y is read (Step #94) after the drawer motor 45 is driven to connect the developer side connector 42Y and the main-body side connector 421, and whether or not the exchange completion flag is set is discriminated (Step #96). Unless the exchange completion flag is set (NO in Step #96), the exchange completion flag is set in the specific area of the cartridge memory 43Y and the developing unit 4 is positioned to the home position (Step #100), thereby ending the cartridge exchange mode, after a specified post-exchange processing including an operation of reading the information on the life saved in the cartridge memory 43Y and writing it in the main-body memory 161 is executed (Step #98).

On the other hand, if the exchange completion flag is not set in Step #84 (NO in Step #84), the developer 4Y is thought to be the one mounted in place of the developer 4Y improperly detached at the start of the cartridge exchange mode. Accordingly, this routine returns to Step #80 after the detachment recovery processing (Step #102) to be described later is executed.

If the exchange completion flag is set in Step #96 (YES in Step #96), the developer 4Y is thought to be the one that was improperly detached from the apparatus main body 1 before without clearing the exchange completion flag. Accordingly, this routine proceeds to Step #98 after executing the mounting recovery processing (Step #104) to be described later. Thus, in this embodiment, Steps #86, #88 of FIG. 11 correspond to an "exchange preparation" of the invention.

In the detachment recovery processing (Step #102) of FIG. 11, whether or not the inner cover 110 has been opened and closed is first discriminated (Step #110) after the start of the cartridge exchange mode as shown in FIG. 12. Specifically, when detecting the opening and closing operations of the inner cover 110 based on the signal level at the port P1 after the start of the cartridge exchange mode in Step #74 of FIG. 10, the CPU 160 has a function of saving such a detection in the main-body memory 161. In Step #110, discrimination is made based on the saved content as to whether or not the inner cover 110 has been opened and closed after the start of the cartridge exchange mode.

Upon discriminating that the inner cover 110 has been operated to be opened and closed after the start of the cartridge exchange mode (YES in Step #110), the CPU 160 judges that the developer 4Y was improperly detached and another developer 4Y was improperly mounted in place of the improperly detached developer 4Y when the rotation of the developing unit 4 is stopped by opening and closing the inner cover 110. In other words, the CPU 160 judges that the developer 4Y having the specific area of the cartridge memory 43Y thereof read in Step #82 is the one improperly mounted.

Accordingly, the developer 42Y is positioned to the detachment position (Step #112); a message urging the remounting of the improperly detached developer is displayed on the display panel 90 (Step #114); and it is waited on standby until the inner cover 110 is opened and closed (NO in Step #116). When the inner cover 110 is judged to be opened and closed (YES in Step #116), the routine is ended upon judging that the improperly detached developer was remounted and Step #80 of FIG. 11 follows. Thereafter, the re-exchange is made in accordance with the procedure of FIG. 11. In other words, Steps #80 to #88 following Step #102 correspond to a "re-exchange preparation" of the invention.

On the other hand, if the inner cover 110 is discriminated not to have been opened and closed after the start of the cartridge exchange mode in Step #110 (NO in Step #110), a maintenance processing is executed to enter a permanent loop (Step #118) since the improper detachment timing is not clear. This maintenance processing may be, for example, such that a message requesting maintenance by a service person is displayed on the display panel 90.

In another example of the detachment recovery processing (Step #102) of FIG. 11, whether or not the inner cover 110 has been opened and closed is first discriminated after the start of the cartridge exchange mode (Step #120) as shown in FIG. 13. No description is given on Step #120 and Step #128 carried out when the discrimination result in Step #120 is negative since these Steps are the same as Steps #110 and #118 of FIG. 12.

Upon discriminating that the inner cover 110 has been operated to be opened and closed after the start of the cartridge exchange mode (YES in Step #120), the developer 4Y is positioned to the home position (Step #122) and a message urging the developer operating button 151Y to be operated again is displayed on the display panel 90 (Step #124) since the present developer 4Y is the one improperly mounted after the improper detachment was made. Then, it is waited on standby until the developer operating button 151Y is operated again (NO in Step #126). Upon discriminating that the developer operating button 151Y has been operated again (YES in Step #126), this routine is ended and Step #80 of FIG. 11 follows. Thereafter, the re-exchange is made in accordance with the procedure of FIG. 11.

In the mounting recovery processing (Step #104) of FIG. 11, after an improper detachment notification is made by displaying, on the display panel 90, a message stating that the developer 4Y mounted this time is the one that was improperly detached from the apparatus main body 1 (Step #130), for example, as shown in FIG. 14, this routine is ended and Step #98 of FIG. 11 follows. Thereafter, the post-exchange processing is made in accordance with the procedure of FIG. 11 (Step #98 of FIG. 11). It should be noted that, in this case, the exchange completion flag is kept set in Step #100 of FIG. 11.

As described above, similar to the first preferred embodiment, when the user instructs the exchange of the developer 4Y, 4C, 4M, 4K by operating the developer operating section 150, the latest data on the remaining amount of the toner (information on the life) saved in the main-body memory 161 is written in the cartridge memory 43Y, 43C, 43M, 43K before the developing unit 4 is positioned to the detachment position to locate the developer 4Y, 4C, 4M, 4K at the developer opening 115 to enable the detachment in this second preferred embodiment. Thus, when this developer 4Y, 4C, 4M, 4K is mounted again, the life of the developer 4Y, 4C, 4M, 4K can be precisely administered using the information on the life read from the cartridge memory 43Y, 43C, 43M, 43K. Therefore, for example, upon mass printing, the developers 4Y, 4C, 4M, 4K can be used as follows. Any developer 4Y, 4C, 4M, 4K being used and containing a small amount of the toner is temporarily detached and stored. After a new developer 4Y, 4C, 4M, 4K is mounted and mass printing is carried out, the new developer 4Y, 4C, 4M, 4K is detached and the stored old one containing a small amount of the toner is mounted again. In this way, the convenience of the apparatus can be improved.

Further, in the second preferred embodiment, the exchange completion flag is written (set) in the cartridge memory 43Y, 43C, 43M, 43K at the time of mounting the developer 4Y, 4C, 4M, 4K into the apparatus main body 1, and is cleared (reset) before the detachment of the developer 4Y, 4C, 4M, 4K from the apparatus main body 1. Thus, the aforementioned improper detachment can be discriminated based on the presence or absence of the exchange completion flag. Specifically, since the specific area of the cartridge memory 43Y of the developer 4Y to be detached is read to confirm whether or not the exchange completion flag is set (Step #84) in the procedure of FIG. 11, discrimination can be made as to whether or not the presently mounted developer 4Y is the one that was improperly mounted in place of the developer 4Y improperly detached from the apparatus main body 1. Further, since the specific area of the cartridge memory 43Y of the mounted developer 4Y is read to confirm whether or not the exchange completion flag is set (Step #96) in the procedure of FIG. 11, discrimination can be made as to whether or not the developer 4Y is the one that was improperly detached from the apparatus main body 1 before. At this time, it is not necessary to provide a separate memory for writing the exchange completion flag (exchange completion information) since the exchange completion flag is written in the existing cartridge memories 43Y, 43C, 43M, 43K.

According to the second preferred embodiment, when the presence or absence of the exchange completion flag is not normal and the improper detachment is judged, the remounting of the improperly detached developer 4Y, 4C, 4M, 4K is urged. Specifically, in the detachment recovery processing shown in FIGS. 12 and 13, whether or not there has been an improper detachment can be judged since discrimination is made as to whether or not the inner cover 110 has been opened and closed until the cartridge memory of the developer to be exchanged is read after the start of the cartridge exchange mode. Upon judging that there has been an improper detachment, the remounting of the improperly detached developer 4Y, 4C, 4M, 4K is urged by displaying a message urging the remounting of the improperly detached developer 4Y, 4C, 4M, 4K on the display panel 90 (Step #114 of FIG. 12) or displaying a message urging the operation of pressing the developer operating button 151Y, 151C, 151M, 151K on the display panel 90 (Step #124 of FIG. 13). This can prevent the improperly detached developer 4Y, 4C, 4M, 4K from being left outside the apparatus main body 1.

Further, according to the processing of FIG. 14, the user can more conveniently use this apparatus since even the developer improperly detached from the apparatus main body 1 before can be further used.

The invention is not limited to the foregoing embodiments, and various changes other than those described above can be made without departing from the scope of the invention.

Third Preferred Embodiment

A third preferred embodiment of the image forming apparatus according to the invention is described. The construction of the image forming apparatus of the third preferred embodiment is substantially the same as that of the first preferred embodiment described with reference to FIGS. 1 to 5. A procedure of entering the cartridge exchange mode and a procedure of the cartridge exchange mode in the third preferred embodiment are the same as those of the second preferred embodiment described with reference to FIGS. 10 to 14. The third preferred embodiment partly differs from the first and second preferred embodiments in its construction and operation, and the following description is centered on different points.

In this third preferred embodiment, a nonvolatile memory as described in the first preferred embodiment is used as the main-body memory 161 (see FIG. 5).

In this third preferred embodiment, the CPU 160 reads and writes information from and in the cartridge memories 43Y, 43C, 43M, 43K only during the cartridge exchange mode except at the time of restoring the power supply to be described later in view of how often rewriting can be made to the cartridge memories 43Y, 43C, 43M, 43K until the lives of the cartridge memories 43Y, 43C, 43M, 43K end, how often the main-body side connector 421 and the developer side connectors 42Y, 42C, 42M, 42K can be connected until the lives of these connectors end, and how often the drawer motor 45 can be driven until the life thereof ends. In other words, the reading and writing from and in the cartridge memories 43Y, 43C, 43M, 43K are carried out only during the cartridge exchange mode in the second preferred embodiment, whereas they are carried out at the time of restoring the power supply in addition to the period of the cartridge exchange mode in the third preferred embodiment.

As described in the first preferred embodiment, it is conceivable that the developers 4Y, 4C, 4M, 4K are improperly detached from the apparatus main body 1 at the following timings. Specifically, since the developing unit 4 is rotated in the rotating direction D5 of FIG. 3A in this image forming apparatus, the developer 4Y reaches the reading/writing position (see FIG. 3B) after passing the detachment position (see FIG. 3C) if the developer operating button 151Y is turned on to enter the cartridge exchange mode with the developing unit 4 located at the home position (see FIG. 3A). Accordingly, if the inner cover 110 is opened when the developer 4Y reaches the detachment position by the rotation of the developing unit 4, the rotation of the developing unit 4 is immediately stopped as described above, thereby making it possible to improperly detach the developer 4Y. Upon such an improper detachment, an amount of the toner actually remaining in the developer 4Y is less than the remaining amount of the toner saved in the cartridge memory 43Y Thus, if this developer 4Y is mounted again later, the remaining amount of the toner in the cartridge memory 43Y is read and the life administration is made based on this data, image failures such as indistinct or blurred images may occur before the exhaustion of the toner is detected.

In view of the above, using specific areas of the cartridge memories 43Y, 43C, 43M, 43K, the CPU 160 writes an exchange completion flag in the specific area of the cartridge memory 43Y, 43C, 43M, 43K when the developer 4Y, 4C, 4M, 4K is mounted into the apparatus main body 1, and clears the exchange completion flag before the developer 4Y, 4C, 4M, 4K is detached from the apparatus main body 1 when the developer operating button 151Y, 151C, 151M, 151K is pressed. In this way, the improper detachment of the developers 4Y, 4C, 4M, 4K from the apparatus main body 1 is made recognizable. This operation is not described since it is the same as the one in the second preferred embodiment described above with reference to FIGS. 10 to 14.

The improper detachment of the developer from the apparatus main body 1 does not necessarily occur during the cartridge exchange mode as described above. For example, the improper detachment of the developer (e.g. developer 4Y) is possible if the developing unit 4 accidentally stops at the detachment position (or position where one of the developers can be detached through the developer opening 115) when the user erroneously turns the power switch off during the operation or the power supply is suddenly shut off, for example, due to a power failure. In such a case, the CPU 160 cannot detect the opening and closing operations of the inner cover 110 since there is no power supply. An initial amount of the toner should be contained in a developer improperly mounted in place of the improperly detached developer 4Y However, since the remaining amount of the toner in the improperly detached developer is kept saved as the life information in the main-body memory 161, the exhaustion of the toner is detected despite the toner still residual in the developer if the life administration is carried out based on this data. In other words, the exchange of the developer is requested to the user with a sufficient amount of the toner still left in the developer.

Accordingly, in this third preferred embodiment, the CPU 160 sets an improper power-supply shutoff flag in the main-body memory 161 before every execution of a specific operation such as the image formation mode and resets it in the main-body memory 161 after the execution of this specific operation. The CPU 160 reads information written in the main-body memory 161 when the image forming apparatus is turned on and judges whether or not the apparatus was turned on to restore the power supply improperly shut off. Specifically, since the improper power-supply shutoff flag remains to be set in the main-body memory 161 if the power supply is improperly shut off during the operation, whether or not the apparatus is turned on to restore the power supply can be discriminated based on the presence or absence of the improper power-supply shutoff flag in the main-body memory 161 when the apparatus is turned on.

The CPU 160 also reads the specific area of the cartridge memory 43Y, 43C, 43M, 43K of the developer 4Y, 4C, 4M, 4K being mounted to judge whether or not the exchange completion flag is written, upon judging that the apparatus was turned on to restore the power supply. Thus, whether or not the developer 4Y, 4C, 4M, 4K was improperly detached from the apparatus main body 1 while the power supply was shut off before being restored can be made recognizable. In this embodiment, the exchange completion flag corresponds to "exchange completion information indicating that the exchange has been normally completed" of the invention; the CPU 160 corresponds to a "power-supply application judging means" and a "third main-body controlling means" of the invention; the main-body memory 161 corresponds to a "nonvolatile memory" of the invention; and the improper power-supply shutoff flag corresponds to "improper power-supply shutoff information indicating that the power supply was improperly shut off" of the invention. These operations are described in detail later.

Here, the "improper power-supply shutoff" means that the power supply is shut off during the operation by an erroneous operation of the power switch by the user or by a power failure.

Further, "that the exchange of the developer cartridge has been normally completed" means that the detachment of the developer 4Y, 4C, 4M, 4K from the apparatus main body 1 and the mounting of the developer 4Y, 4C, 4M, 4K in place of the detached developer 4Y, 4C, 4M, 4K were carried out in a specified procedure during the cartridge exchange mode, e.g. means that the intrinsic information such as the information on the life is normally read and written from and in the cartridge memory 43Y, 43C, 43M, 43K. In other words, if the exchange completion flag is not written in the cartridge memory 43Y, 43C, 43M, 43K of the developer 4Y, 4C, 4M, 4K at the time of restoring the power supply, it means that the developer 4Y, 4C, 4M, 4K being mounted is not the one that was mounted in the specified procedure during the cartridge exchange mode.

Figure 15:
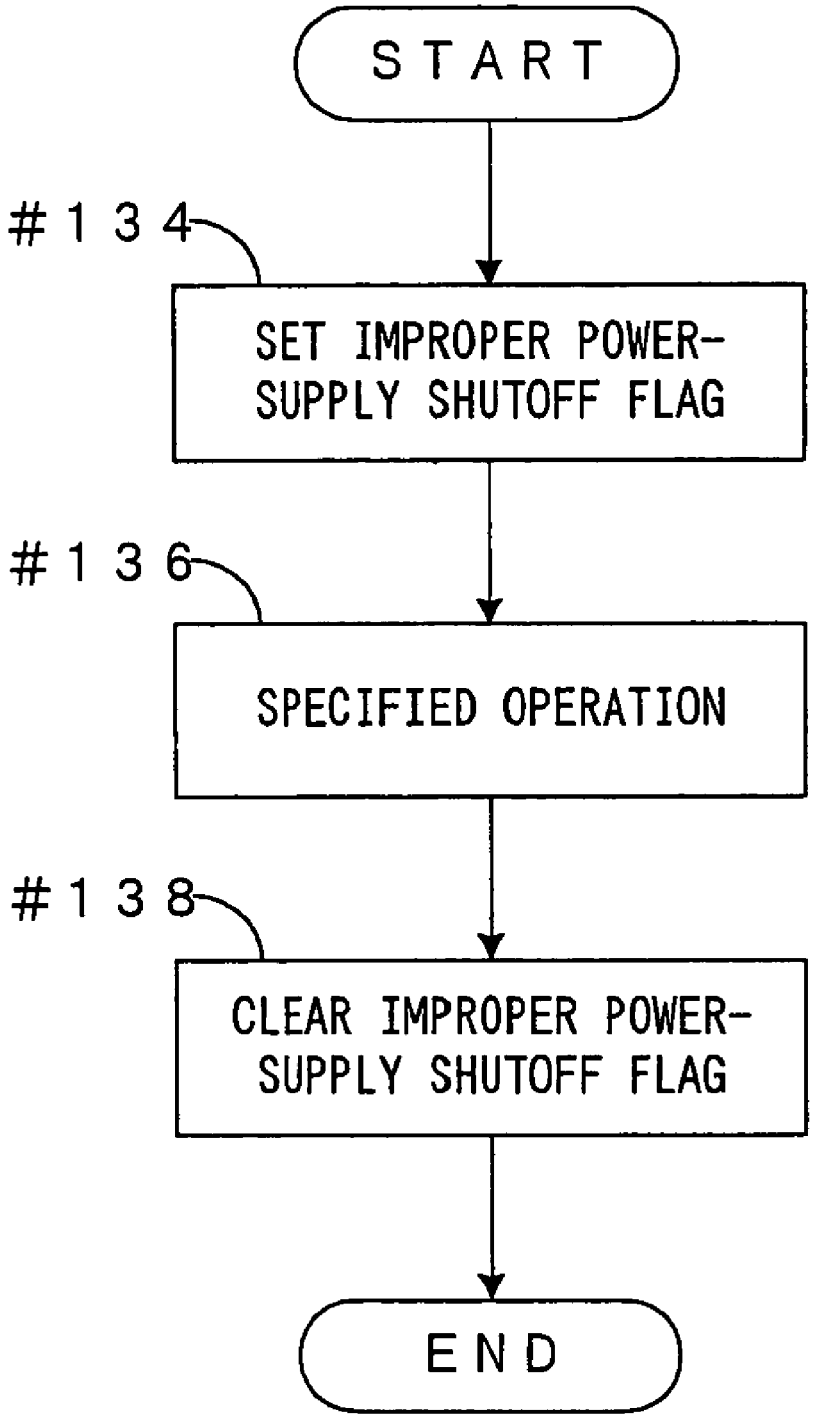
FIG. 15 is a flow chart showing a procedure of writing an inadvertent power shutoff flag in a third preferred embodiment of the image forming apparatus of the invention.
Figure 16:
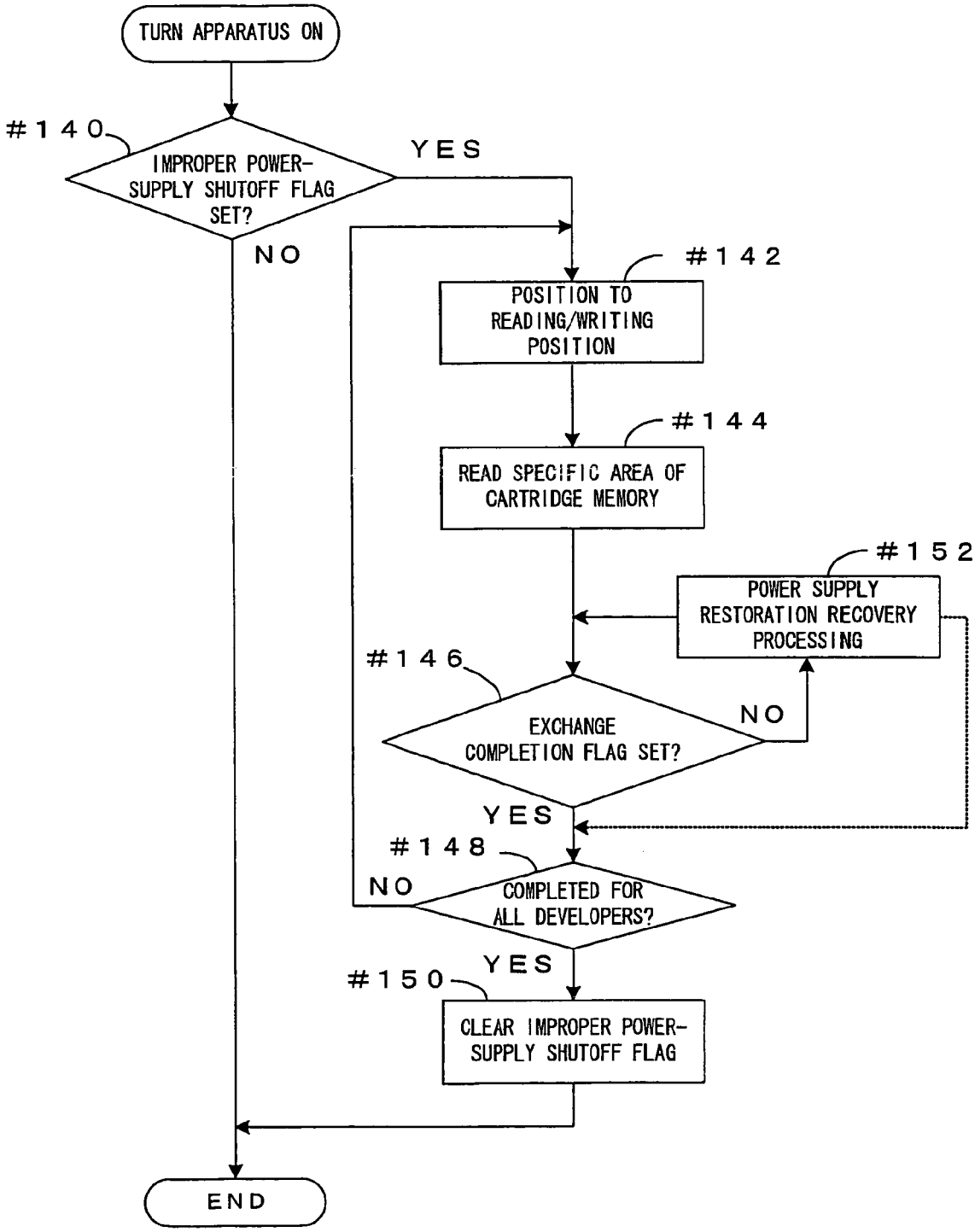

FIG. 15 is a flow chart showing a procedure of writing the improper power-supply shutoff flag, and FIG. 16 is a flow chart showing a procedure of turning the image forming apparatus on. In FIG. 15, every time a specified operation is executed (Step #136), the improper power-supply shutoff flag is written in the main-body memory 161 before the execution of this specified operation (Step #134) and the improper power-supply shutoff flag is cleared from the main-body memory 161 (Step #138) after the execution of this specified operation. This specific operation may be an operation in the image formation mode in accordance with a print command signal from an external apparatus, an operation in a specified initialization executed when the apparatus is turned on.

In FIG. 16, when the apparatus is turned on, whether or not the improper power-supply shutoff flag is written in the main-body memory 161 is first judged (Step #140). Upon judging that the improper power-supply shutoff flag is not written (NO in Step #140), this routine is ended to carry out the specified initialization executed when the apparatus is turned on. On the other hand, upon judging that the improper power-supply shutoff flag is written in the main-body memory 161 (YES in Step #140), the developing unit 4 is positioned to the reading/writing position (developing position) (Step #142) so that the developer side connector 42Y of the developer (here, e.g. developer 4Y) comes to be located at the position facing the main-body side connector 421 (see FIG. 3B). Subsequently, after the drawer motor 45 is driven to connect the developer side connector 42Y and the main-body side connector 421, the specific area of the cartridge memory 43Y is read (Step #144) and whether or not the exchange completion flag is set is discriminated (Step #146). If the exchange completion flag is set (YES in Step #146), discrimination is made as to whether or not the reading of the cartridge memories of all the developers has been completed (Step #148). If the reading has not been completed yet (NO in Step #148), this routine returns to Step #142 to repeat the operations described above. Upon completing the reading of the cartridge memories of all the developers (YES in Step #148), it is judged that no developer 4Y, 4C, 4M, 4K has been improperly detached during the improper shutoff of the power supply this time and the improper power-supply shutoff flag in the main-body memory 161 is cleared (Step #150), thereby ending this routine.

On the other hand, if the exchange completion flag is not set in Step #146 (NO in Step #146), a permanent loop is entered (Step #152) to execute a specified power supply restoration recovery processing upon judging that the developer being mounted is the one that was improperly mounted during the shutoff of the power supply. For example, an improper mounting notification may be given by displaying a message stating that there was an improper mounting on the display panel 90 as this power supply restoration recovery processing. Further, maintenance by a service person may be requested in place of or in addition to the above improper mounting notification.

As described above, in this third preferred embodiment, similar to the first preferred embodiment, when the user instructs the exchange of the developer 4Y, 4C, 4M, 4K by operating the developer operating section 150, the latest data of the remaining amount of the toner saved in the main-body memory 161 is renewably written in the cartridge memory 43Y, 43C, 43M, 43K before the developing unit 4 is positioned to the detachment position to locate the developer 4Y, 4C, 4M, 4K at the developer opening 115 to make the detachment possible. Thus, the life of the developer 4Y, 4C, 4M, 4K can be precisely administered using the information on the life read from the cartridge memory 43Y, 43C, 43M, 43K when this developer 4Y, 4C, 4M, 4K is remounted. Accordingly, for example, upon mass printing, the developers 4Y, 4C, 4M, 4K can be used as follows. Any developer 4Y, 4C, 4M, 4K being used and containing a small amount of toner is temporarily detached and stored. After a new developer 4Y, 4C, 4M, 4K is mounted and mass printing is carried out, the new developer 4Y, 4C, 4M, 4K is detached and the stored old one containing a small amount of toner is mounted again. In this way, the convenience of the apparatus can be improved.

Further, similar to the second preferred embodiment, the exchange completion flag is written (set) in the cartridge memory 43Y, 43C, 43M, 43K at the time of mounting the developer 4Y, 4C, 4M, 4K into the apparatus main body 1, and is cleared (reset) before the detachment of the developer 4Y, 4C, 4M, 4K from the apparatus main body 1 in the third preferred embodiment. Thus, the aforementioned improper detachment can be discriminated based on the presence or absence of the exchange completion flag. Specifically, since the specific area of the cartridge memory 43Y of the developer 4Y to be detached is read to confirm whether or not the exchange completion flag is set (Step #84) in the procedure of FIG. 11, discrimination can be made as to whether or not the presently mounted developer 4Y is the one that was improperly mounted in place of the developer 4Y improperly detached from the apparatus main body 1. Further, since the specific area of the cartridge memory 43Y of the mounted developer 4Y is read to confirm whether or not the exchange completion flag is set (Step #96) in the procedure of FIG. 11, discrimination can be made as to whether or not the developer 4Y is the one that was improperly detached from the apparatus main body 1 before. At this time, it is not necessary to provide a separate memory for writing the exchange completion flag (exchange completion information) since the exchange completion flag is written in the existing cartridge memories 43Y, 43C, 43M, 43K.

Further, similar to the second preferred embodiment, when the presence or absence of the exchange completion flag is not normal and the improper detachment is judged, the remounting of the improperly detached developer 4Y, 4C, 4M, 4K is urged in the third preferred embodiment. Specifically, in the detachment recovery processing shown in FIGS. 12 and 13, whether or not there has been an improper detachment can be judged since discrimination is made as to whether or not the inner cover 110 has been opened and closed until the cartridge memory of the developer to be exchanged is read after the start of the cartridge exchange mode. Upon judging that there has been an improper detachment, the remounting of the improperly detached developer 4Y, 4C, 4M, 4K is urged by displaying a message urging the remounting of the improperly detached developer 4Y, 4C, 4M, 4K on the display panel 90 (Step #114 of FIG. 12) or displaying a message urging the operation of pressing the developer operating button 151Y, 151C, 151M, 151K on the display panel 90 (Step_#124 of FIG. 13). This can prevent the improperly detached developer 4Y, 4C, 4M, 4K from being left outside the apparatus main body 1.

Further, similar to the second preferred embodiment, the user can more conveniently use this apparatus since even the developer improperly detached from the apparatus main body 1 before can be further used according to the processing of FIG. 14.

Although the procedure of FIG. 15 according to the third preferred embodiment is disadvantageous in view of the life of the main-body memory 161 and a processing time since the writing is made to the main-body memory 161 with an increased frequency, the improper shutoff of the power supply can be securely detected. Further, according to the procedure of FIG. 16, whether or not the exchange completion flag is written in the specific area of the cartridge memory 43Y, 43C, 43M, 43K is judged at the time of restoring the power supply improperly shut off. Thus, the improper detachment of the developer 4Y, 4C, 4M, 4K during the improper shutoff of the power supply can be securely recognized.

<Modifications of the Third Preferred Embodiment>

The present invention is not limited to the foregoing embodiments and various changes other than the above can be made without departing the scope thereof.

For example, the power supply restoration recovery processing in Step #152 of FIG. 16 is not limited to the one of the third preferred embodiment. For instance, in place of or in addition to the above notification of the improper mounting, the information on the life saved in the cartridge memory 43Y, 43C, 43M, 43K of the developer 4Y, 4C, 4M, 4K being mounted and judged to be the improper one is read and written in the main-body memory 161; the exchange completion flag is written in the cartridge memory 43Y, 43C, 43M, 43K; and this routine jumps from Step #152 to Step #148 as shown in broken line in FIG. 16. With such an arrangement, the user can more conveniently use this apparatus since the improperly mounted developer 4Y, 4C, 4M, 4K can be further used.

Further, in the power supply restoration recovery processing in Step #152 of FIG. 16, a message urging the re-exchange of the developer to the one improperly detached from the apparatus main body 1 while the power supply is improperly shut off before being restored may be displayed on the display panel 90 in place of or in addition to the notification of the improper mounting. This can prevent the improperly detached developer from being left outside the apparatus main body 1.

Figure 17:
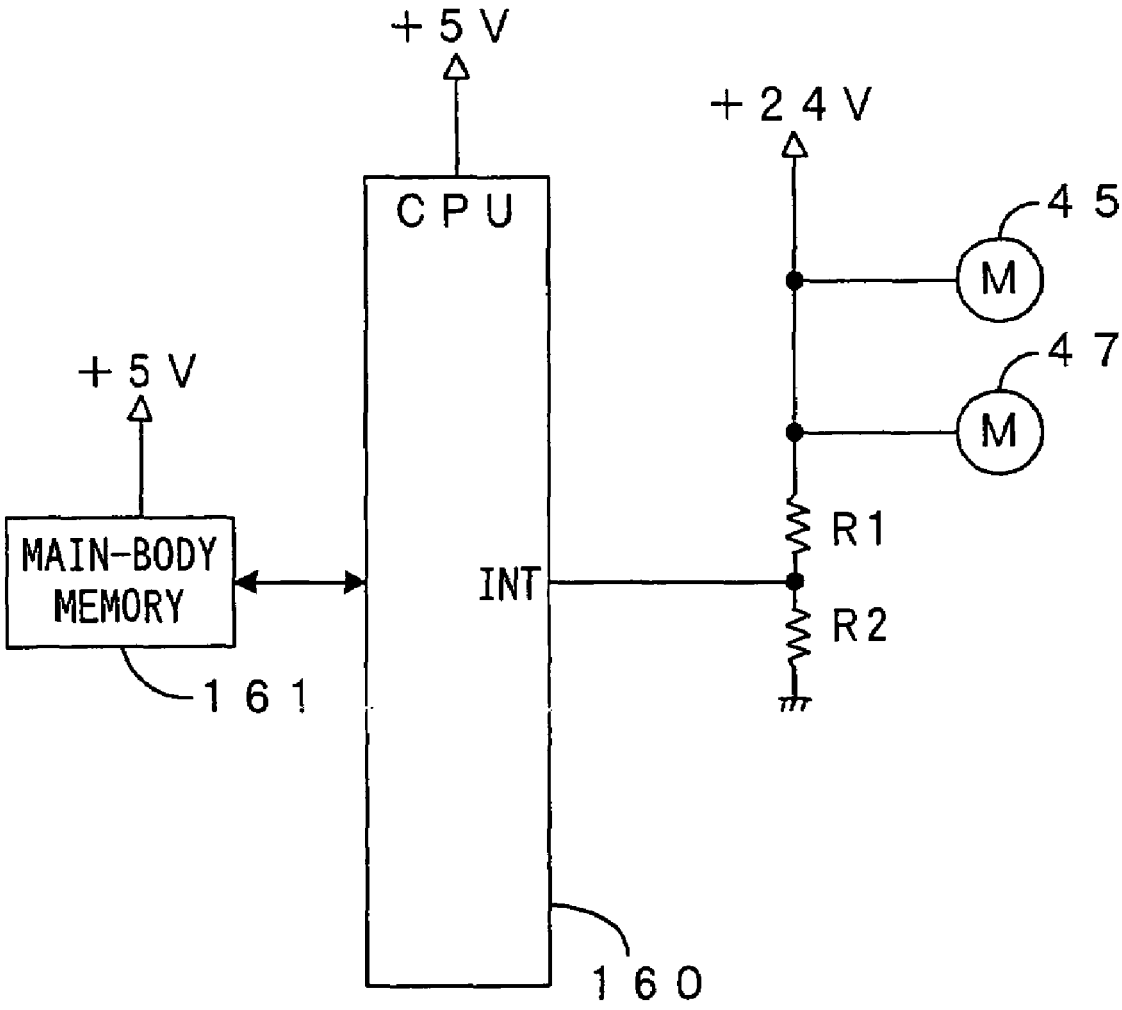
FIG. 17 is a diagram showing a power supplying system according to a modification of the third preferred embodiment.
Figure 18:
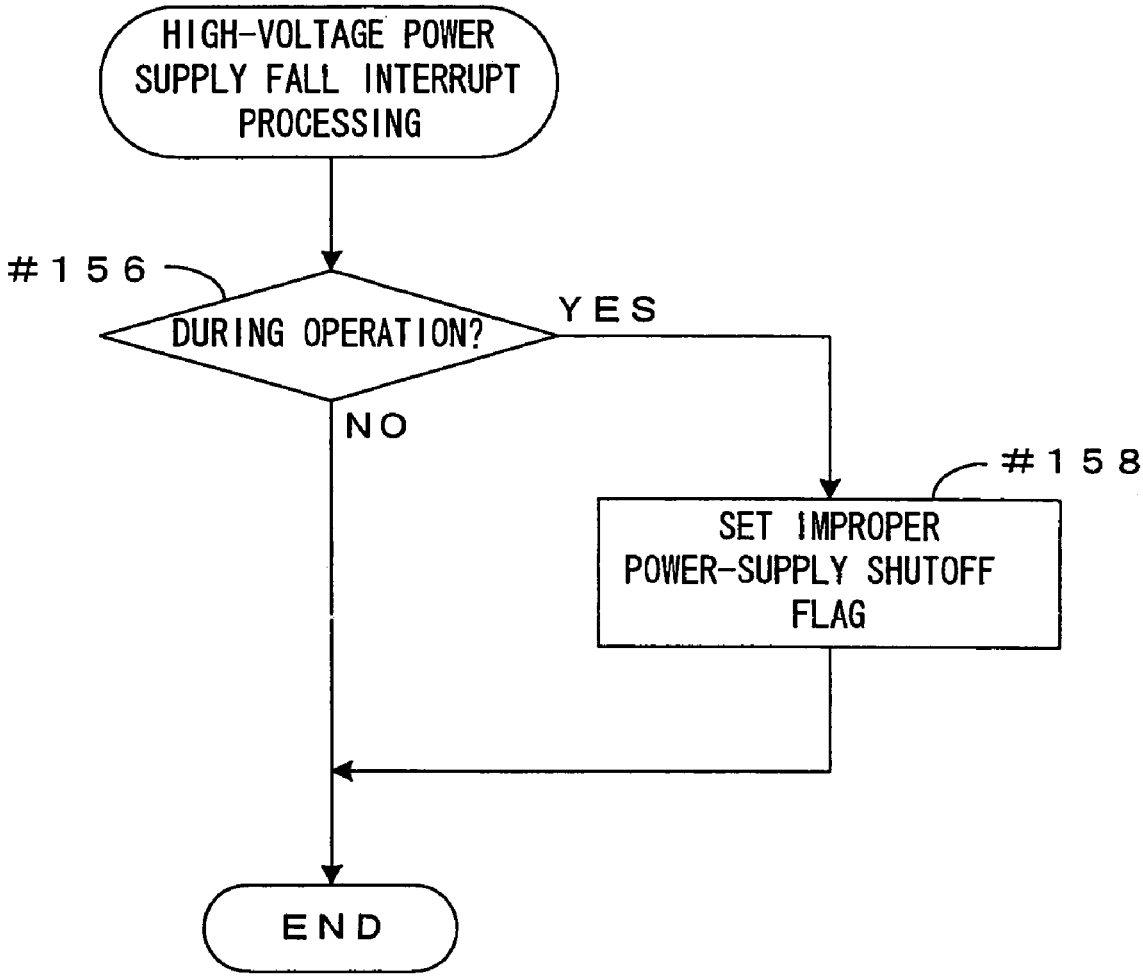
FIG. 18 is a flow chart showing another procedure of writing the inadvertent power shutoff flag in the third preferred embodiment.

The procedure of writing the improper power-supply shutoff flag is not limited to the one of FIG. 15 according to the third preferred embodiment. FIG. 17 is a diagram showing a power supplying system in another embodiment, and FIG. 18 is a flow chart showing another procedure of writing the improper power-supply shutoff flag. It should be noted that elements having the same functions as those of the first preferred embodiment (see FIG. 5) are identified by the same reference numerals in FIG. 17.

In the embodiment of FIG. 17, the drawer motor 45 and the stepping motor 47 operate on a high-voltage power supply (e.g. +24V in FIG. 17), whereas the CPU 160 and the main-body memory 161 operate on a low-voltage power supply (e.g. +5V in FIG. 17). Divided-voltage values obtained by dividing the high-voltage power supply by two voltage-dividing resistors R1 and R2 are inputted to an interrupt port INT of the CPU 160. The moment the voltage level at the interrupt port INT falls to or below a specified level, the CPU 160 executes a high-voltage power supply fall interrupt processing shown in FIG. 18 independently of the routine being currently executed.

In FIG. 18, whether or not any operation is being executed is first discriminated (Step #156). If no operation is being executed (NO in Step #156), it is thought that the apparatus is in a normal off-state and there is no likelihood that the developing unit 4 stops at the detachment position. Thus, this routine is ended at this stage. On the other hand, if some operation is being executed (YES in Step #156), the improper power-supply shutoff flag is written in the main-body memory 161 (Step #158) upon judging the improper power-supply shutoff caused by, e.g. an erroneous operation of turning the power switch off by the user or a power failure, and then this routine is ended.

Although this modification necessitates such a construction that the CPU 160 detects the voltage level of the high-voltage power supply as shown in FIG. 18 unlike the third preferred embodiment, the number of the writing made to the main-body memory 161 is remarkably reduced as compared to the third preferred embodiment. Therefore, this modification is more advantageous in terms of the life of the main-body memory 161 and a processing time.

<Modification Common to the Second and Third Preferred Embodiments>

The detachment recovery processing (Step #102) of FIG. 11 according to the second and third preferred embodiments is not limited to the procedures shown in FIGS. 12 and 13, and the mounting recovery processing (Step #104) of FIG. 11 is not limited to the one shown in FIG. 14. As the detachment recovery processing and the mounting recovery processing, the routine may, for example, enter a permanent loop as in the maintenance processing in Step #118 of FIG. 12 without returning to the procedure of FIG. 11, thereby requiring maintenance by a service person. In this permanent loop, an improper detachment notification may be made, i.e. a message of the occurrence of the improper detachment may be displayed on the display panel 90.

<Modification Common to the First Through Third Preferred Embodiments>

The first through third preferred embodiments concern the apparatus provided with the rotary developing unit into which four developers corresponding to four colors of yellow, cyan, magenta and black are mountable and also provided with a reversing conveyance path FR to enable the formation of images on both surfaces of a sheet S. The invention is not limited to such an apparatus, and is applicable to apparatuses provided with a developing unit in which a different number of developers are mountable or those for forming an image only on one surface of a sheet S. The invention is particularly effective when being applied to image forming apparatuses constructed such that a reading/writing position and a detachment position of a developing unit differ and the developing unit passes the detachment position while being moved to the reading/writing position, those constructed such that an inner cover for closing a developer opening can be freely opened by a user, and those constructed such that the reading and writing from and in cartridge memories are discontinuously performed instead of being constructed such that a CPU of an apparatus main body is constantly connected with the cartridge memories to enable the constant reading and writing from and in the cartridge memories.

Although the invention has been described with reference to specific embodiments, this description is not meant to be construed in a limiting sense. Various modifications of the disclosed embodiments, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus, comprising:

a developer cartridge containing a toner and detachably mountable into an apparatus main body;

a cartridge storage means for saving intrinsic information including information on the life of the developer cartridge provided in the developer cartridge; and a first main-body controlling means for writing improper detachment information for making an improper detachment of said developer cartridge from the apparatus main body recognizable in said cartridge storage means.

2. An image forming apparatus according to claim 1, wherein said first main-body controlling means writes the improper detachment information in said cartridge storage means of said developer cartridge at the time of mounting said developer cartridge into the apparatus main body.

3. An image forming apparatus according to claim 2, wherein said first main-body controlling means reads information written in said cartridge storage means of said developer cartridge at the time of mounting said developer cartridge into the apparatus main body to judge whether or not the improper detachment information is written, and writes the improper detachment information in said cartridge storage means when it is judged that the improper detachment information is not written.

4. An image forming apparatus according to claim 3, wherein said first main-body controlling means executes an abnormality processing when judging that the improper detachment information is written in said cartridge storage means of said mounted developer cartridge.

5. An image forming apparatus according to claim 3, further comprising:

a main-body storage means provided in the apparatus main body; and a life calculating means for calculating a life value corresponding to a remaining amount of the toner in said developer cartridge and renewably saving the calculated life value in said main-body storage means, wherein said first main-body controlling means reads at least the information on the life written in said cartridge storage means and writes it in said main-body storage means when judging that the improper detachment information is not written in said cartridge storage means, and said life calculating means calculates an added value of values corresponding to an amount of toner consumed at every image forming operation and calculates the life value based on the calculated added value, and the information on the life written in said main-body storage means.

6. An image forming apparatus according to claim 5, further comprising:

a cartridge supporting means which is movable relative to the apparatus mainbody and into which at least one developer cartridge is mountable;

a driving means for driving said cartridge supporting means to position said cartridge supporting means at least to a specified detachment position and a specified reading/writing position; and a drive controlling means for controlling the operation of said driving means to control the positioning of said cartridge supporting means, wherein the detachment position is such a position where said developer cartridge can be detached through a developer cartridge opening formed in the apparatus main body, the reading/writing position is such a position where the reading and writing from and in said cartridge storage means by said first main-body controlling means are possible, upon a detachment instruction to detach said developer cartridge from the apparatus main body, said first main-body controlling means reads the information written in said cartridge storage means of said developer cartridge to judge whether or not the improper detachment information is written, and executes a detachment preparation during which the life value is written in said cartridge storage means as the information on the life and the improper detachment information is cleared when it is judged that the improper detachment information is written, and said drive controlling means first positions said cartridge supporting means to the reading/writing position upon the detachment instruction and then positions said cartridge supporting means to the detachment position after the completion of the detachment preparation by said first main-body controlling means.

7. An image forming apparatus according to claim 6, wherein said first main-body controlling means executes an abnormality processing when it is judged that the improper detachment information is not written in said cartridge storage means of said developer cartridge to be detached.

8. An image forming apparatus according to claim 6, further comprising a cover for closing the developer cartridge opening, wherein said driving means stops driving said cartridge supporting means when said cover is opened.

9. An image forming apparatus according to claim 6, wherein said cartridge supporting means is so constructed as to rotate said developer cartridge about an axis of rotation substantially normal to an opening plane of the developer cartridge opening.

10. An image forming apparatus according to claim 6, further comprising:

a cover for closing the developer cartridge opening; and a detecting means for detecting open and closed states of said cover, wherein said drive controlling means judges that said developer cartridge has been mounted into the apparatus main body when said cover is detected to have been closed after being opened with said cartridge supporting means located at the detachment position after the completion of the detachment preparation.

11. An image forming apparatus according to claim 1, wherein said first main-body controlling means reads information written in said cartridge storage means of said developer cartridge to judge whether or not the improper detachment information is written when a predetermined storage controlling condition is satisfied with said developer cartridge mounted in the apparatus main body, and writes the improper detachment information in said cartridge storage means when it is judged that the improper detachment information is not written.

12. An image forming apparatus according to claim 11, wherein the storage controlling condition is satisfied when the apparatus is turned on.

13. An image forming apparatus according to claim 11, wherein the storage controlling condition is satisfied when the number of prints made reaches a predetermined value.

14. An image forming apparatus according to claim 11, wherein the storage controlling condition is satisfied when a print command signal is inputted from an external apparatus.

15. An image forming apparatus according to claim 11, further comprising:

a main-body storage means provided in the apparatus main body; and a life calculating means for calculating a life value corresponding to a remaining amount of the toner in said developer cartridge and renewably saving the calculated life value in said main-body storage means, wherein said first main-body controlling means saves at least the information on the life written in said cartridge storage means in said main-body storage means when it is judged that the improper detachment information is not written in said cartridge storage means, and said life calculating means calculates an added value of values corresponding to an amount of toner consumed at every image forming operation and calculates the life value based on the calculated added value, and the information on the life saved in said main-body storage means.

16. An image forming apparatus according to claim 15, further comprising:

a cartridge supporting means which is movable relative to the apparatus main body and into which at least one developer cartridge is mountable;

a driving means for driving, said cartridge supporting means to position said cartridge supporting means at least to a specified detachment position and a specified reading/writing position; and a drive controlling means for controlling the operation of said driving means to control the positioning of said cartridge supporting means, wherein the detachment position is such a position where said developer cartridge can be detached through a developer cartridge opening formed in the apparatus main body, the reading/writing position is such a position where the reading and writing from and in said cartridge storage means by said first main-body controlling means are possible, upon a detachment instruction to detach said developer cartridge from the apparatus main body, said first main-body controlling means executes a detachment preparation of updating the information on the life saved in said cartridge storage means of said developer cartridge to the life value renewably saved in said main-body storage means, and of clearing the improper detachment information, and said drive controlling means first positions said cartridge supporting means to the reading/writing position upon the detachment instruction and then positions said cartridge supporting means to the detachment position after the completion of the detachment preparation by said first main-body controlling means.

17. An image forming apparatus according to claim 16, wherein said first main-body controlling means reads the information written in said cartridge storage means of said mounted developer cartridge to judge whether or not the improper detachment information is written when said developer cartridge is mounted into the apparatus main body, and executes an abnormality processing when it is judged that the improper detachment information is written.

18. An image forming apparatus according to claim 16, further comprising a cover for closing the developer cartridge opening, wherein said driving means stops driving said cartridge supporting means when said cover is opened.

19. An image forming apparatus according to claim 16, wherein said cartridge supporting means is so constructed as to rotate said developer cartridge about an axis of rotation substantially normal to an opening plane of the developer cartridge opening.

20. An image forming apparatus according to claim 16, further comprising:

a cover for closing the developer cartridge opening; and a detecting means for detecting open and closed states of said cover, wherein said drive controlling means judges that said developer cartridge was mounted into the apparatus main body upon detecting that said cover was closed after being opened with said cartridge supporting means positioned at the detachment position after the completion of the detachment preparation, and positions said cartridge supporting means to the reading/writing position.

21. A method for controlling the storage of information on an improper detachment of a developer cartridge in an image forming apparatus in which a developer cartridge containing a toner is detachably mountable into an apparatus main body and a cartridge storage means for saving intrinsic information including information on the life of said developer cartridge is provided in said developer cartridge, said method comprising the steps of:

writing improper detachment information for making the improper detachment of said developer cartridge from the apparatus main body recognizable in said cartridge storage means; and clearing the improper detachment information written in said cartridge storage means upon a detachment instruction to detach said developer cartridge from the apparatus main body.

22. A method according to claim 21, wherein said step of writing the improper detachment information in said cartridge storage means is performed at the time of mounting said developer cartridge into the apparatus main body.

* * * * *